US008695231B2

(12) United States Patent
Sugimoto et al.

(10) Patent No.: US 8,695,231 B2
(45) Date of Patent: Apr. 15, 2014

(54) METHOD FOR CONTROLLING DRYING OF CLOTHES AND DRYER FOR CLOTHES

(75) Inventors: Yasuyo Sugimoto, Aichi (JP); Tsutomu Katou, Aichi (JP); Tetsuya Ueda, Aichi (JP); Takuya Kotanagi, Aichi (JP); Ippei Oda, Aichi (JP); Kazuhiro Taniguchi, Aichi (JP)

(73) Assignee: Panasonic Corporation, Osaka (JP)

( * ) Notice: Subject to any disclaimer, the term of this patent is extended or adjusted under 35 U.S.C. 154(b) by 715 days.

(21) Appl. No.: 12/922,289

(22) PCT Filed: Mar. 6, 2009

(86) PCT No.: PCT/JP2009/001023

§ 371 (c)(1),
(2), (4) Date: Sep. 13, 2010

(87) PCT Pub. No.: WO2009/113284

PCT Pub. Date: Sep. 17, 2009

(65) Prior Publication Data

US 2011/0047812 A1 Mar. 3, 2011

(30) Foreign Application Priority Data

Mar. 13, 2008 (JP) ..... 2008-063689
Jul. 3, 2008 (JP) ..... 2008-174151
Aug. 21, 2008 (JP) ..... 2008-212338

(51) Int. Cl.
*F26B 3/02* (2006.01)

(52) U.S. Cl.
USPC ..... 34/493; 34/495

(58) Field of Classification Search
USPC ..... 34/486, 491, 492, 493, 494, 495, 524, 34/528, 529, 549, 553, 572, 202
See application file for complete search history.

(56) References Cited

U.S. PATENT DOCUMENTS 5,459,301 A * 10/1995 Miller et al. ..... 219/679
5,651,192 A * 7/1997 Horwitz ..... 34/529

FOREIGN PATENT DOCUMENTS

| | | | |
|---|---|---|---|
| JP | S6343927 | U | 3/1988 |
| JP | 56-74898 | | 6/1991 |
| JP | 7-116386 | A | 5/1995 |
| JP | 7-139759 | A | 5/1995 |
| JP | 08100946 | A | 4/1996 |
| JP | 11-156097 | A | 6/1999 |
| JP | 2001-208413 | A | 8/2001 |
| JP | 2001208413 | A | 8/2001 |
| JP | 2002-277162 | A | 9/2002 |
| JP | 2003172524 | A | 6/2003 |
| JP | 2004-132668 | A | 4/2004 |
| JP | 2004132668 | A | 4/2004 |
| JP | 2007-240063 | A | 9/2007 |
| JP | 2008-96006 | A | 4/2008 |

OTHER PUBLICATIONS

International Search Report for PCT/JP2009/001023, Apr. 21, 2009.

* cited by examiner

*Primary Examiner* — Jiping Lu
(74) *Attorney, Agent, or Firm* — RatnerPrestia

(57) ABSTRACT

A control method for drying clothes is disclosed. The method finds a difference in surface temperature between clothes catching air blow and the same clothes catching no air blow, and then determines a degree of dryness in the clothes based on the difference. Based on the degree of dryness, the method determines at what time heating should start.

2 Claims, 27 Drawing Sheets

METHOD FOR CONTROLLING DRYING OF CLOTHES AND DRYER FOR CLOTHES

This application is a U.S. National Phase Application of PCT International Application PCT/JP2009/001023.

TECHNICAL FIELD

The present invention relates to a control method for drying clothes in an ordinary house, and the invention also relates to a clothes-dryer.

BACKGROUND ART

The washing has been usually hung on a line or a pole outside the house for being dried by the sun light. However, the numbers of double-income households and bachelor households have increased recently, so that the washing of those households cannot be taken in when it rains during the daytime. Those households often do a washing in the evening, and hang the washing inside the house to dry, e.g. in the bath. Hanging the washing to dry inside the house has prevailed in those households, and it also prevents the washing from being stolen.

In a case where the washing is hung inside the house to dry, particularly in the bath, a clothes dryer having functions of heating, blowing, and ventilating is used for drying the clothes fast. In this case, since each piece of the washing can be dried in a different time from each other, uneven dry in the washing has occurred as a problem. For instance, if the clothes dryer is run until the clothes requiring the longest drying time are dried, other clothes requiring a shorter drying time have been over-dried, and as a result, energy is wasted.

A clothes-dryer taking measures against such uneven dry is disclosed in, e.g. Patent Literature 1. FIG. 35 shows a sectional view of a conventional clothes dryer. As shown in FIG. 35, the clothes dryer is used in the bath, and it comprises the following elements: circulation blower 101, louver device 102 for changing an air direction, heater 103, controller 104, surface temperature sensor 105, and temperature detector 106.

Circulation blower 101 sucks the air in the bath, and heats the air, then blows the heated air into the bath again. Louver device 102 changes a direction of the air blown from blower 101. Controller 104 controls blower 101, louver device 102, and heater 103. Surface temperature sensor 105 senses a temperature on the surface of the clothes, and temperature detector 106 detects a temperature inside a circulation air duct.

When a difference between a surface temperature, sensed by sensor 105, of the clothes and another temperature, detected by detector 106, of the circulating air is great, or this difference changes fast, controller 104 determines that the clothes are not dried yet, i.e. they are in a low degree of dryness, and then controller 104 blows heated air to these clothes.

The conventional dry-control method and the clothes dryer discussed above erroneously determine wet clothes as dried clothes when the clothes get radiation heat such as the sun light on their surfaces. It is thus hard to determine accurately the degree of dryness in the clothes, so that an optimum starting time for heating cannot be fixed. As a result, the clothes cannot be dried in an energy saving manner within a time desired by a user.

Patent Literature 2 discloses a clothes dryer that dries clothes by blowing air. This kind of conventional clothes dryer is described hereinafter with reference to FIGS. 36 and 37. FIG. 36 shows an external appearance of a louver device, which changes an airflow direction, of the conventional clothes dryer, and FIG. 37 shows a sectional view of a main unit of the conventional clothes dryer.

As shown in FIGS. 36 and 37, louvers 121 are mounted inside blow-off port 125 of main unit 124 of the clothes dryer, and louvers 121 can be rotated by motor 122 for generating multi-directional airflow. Louvers 121 slant with respect to rotary shaft 123 at the same tilt with each other. When sirocco fan 126 blows an airflow from blow-off port 125 to the inside of the bath, motor 122 rotates louvers 121 for blowing the airflow in multi-directions.

This clothes dryer blows the airflow periodically to a large amount of clothes hung on a broad line or a pole even at the line ends or the pole ends, where the clothes can be dried last of all, but the dryer cannot blow the airflow continuously to the entire clothes hung on the broad line. The clothes dryer thus needs a long drying time.

In a case where a user wants to dry a small amount of washing in a short time such as only one pair of jeans or a heavy clothing, blowing air in a wide area results in not only wasting energy but also prolonging a drying time because a speed of air blown to the washing is low.

Patent Literature 3 discloses a louver device of an air-conditioner for dehumidification, and the louver device is designed to blow the air uniformly to a wide area. FIG. 38 shows a perspective view of this conventional louver device.

As shown in FIG. 38, the louver device comprises the following elements: flap 142, flap-driver 143, multiple louvers 144, louver-driver 145, transmission mechanism 146, and connecting rods. Flap 142 pivots vertically on a lateral shaft mounted across blow-off port 141, and flap driver 143 drives flap 142 vertically. Multiple louvers 144 pivot laterally on vertical shafts mounted across blow-off port 141 and lying at right angles to the lateral shaft. Louver driver 145 drives louvers 144 laterally. Transmission mechanism 146 converts the rotary movement of driver 145 into linear movement along an extension line of the lateral shaft, thereby transmitting the driving force to louvers 144. The connecting rods allow multiple louvers 144 to pivot together in the same manner. This structure allows transmitting the driving force of driver 145 to louvers 144 within a limited space.

Since louvers 144 are separately placed from flap 142 in the foregoing conventional louver device, the structure of the device is obliged to be complicated and incurs a greater pressure-loss due to airflow resistance. It is thus needed to decrease the pressure loss.

Patent Literature 1: Unexamined Japanese Patent Application Publication No. 2002-277162

Patent Literature 2: Unexamined Japanese Patent Application Publication No. H07-139759

Patent Literature 3: Unexamined Japanese Patent Application Publication No. 2007-240063

DISCLOSURE OF INVENTION

A control method for drying clothes of the present invention determines a degree of dryness in the clothes based on a difference in surface temperature of the clothes between a state where air is blown to the clothes and another state where the air is not blown to the same clothes. Then the control method fixes a heat starting time based on the degree of dryness.

The foregoing control method for drying the clothes measures a surface temperature of the clothes twice; the first measurement is done when the clothes catch air blow, and the second measurement is done when the clothes do not catch the air blow, because when wet clothes catch the air blow, the temperature lowers due to heat of evaporation. A greater difference in the surface temperature indicates a greater amount of moisture is contained in the clothes. On the contrary, a smaller difference in surface temperature indicates a smaller amount of moisture is contained in the clothes. A degree of dryness of the wet clothes can be thus determined accurately, and the control method can accurately predict a dry-end time of the clothes.

A clothes-dryer of the present invention comprises the following elements: a blower for blowing air to clothes, a surface temperature sensor for sensing a surface temperature of the clothes, a heater for heating the clothes, an absolute humidity sensor for sensing an absolute humidity around the clothes, a controller for controlling the blower and the heater, a drying predictor for predicting a time necessary for drying the clothes based on the information sent from the surface temperature sensor and the absolute humidity sensor, a time input device for a user to input a target time by which the clothes should be dried, a heat indication device for indicating a timing when the heater should be used, and a timer for measuring time.

Using the blower, the controller forms a state where the clothes catch the air blow and another state where the clothes do not catch the air blow. The drying predictor calculates a difference in surface temperature between the state where the clothes catch the air blow and the other state where the clothes do not catch the air blow based on the following information: This difference is referred to as a degree of dryness in the clothes.

- availability of the air blown to the clothes;
- the clothes' surface temperature sensed by the surface temperature sensor; and
- the absolute around-the-clothes humidity sensed by the absolute humidity sensor.

The drying predictor then predicts a dry-end time based on the degree of dryness assuming that the drying of the clothes starts from the calculation of the difference. The heat indication device compares the dry-end time with the target time, and when the dry-end time is the same as or later than the target time, the heat indication device prompts the controller to use the heater.

When wet clothes catch the air blow, the temperature of the clothes lowers due to heat of evaporation. The clothes dryer discussed above thus accurately determines the degrees of dry in the clothes at intervals, thereby fixing the heat starting time so that the heating time can be shortened. As a result, the clothes dryer of the present invention can finish drying the clothes in an energy saving manner within a time desired by a user.

DESCRIPTION OF REFERENCE SIGNS

Figure 1:
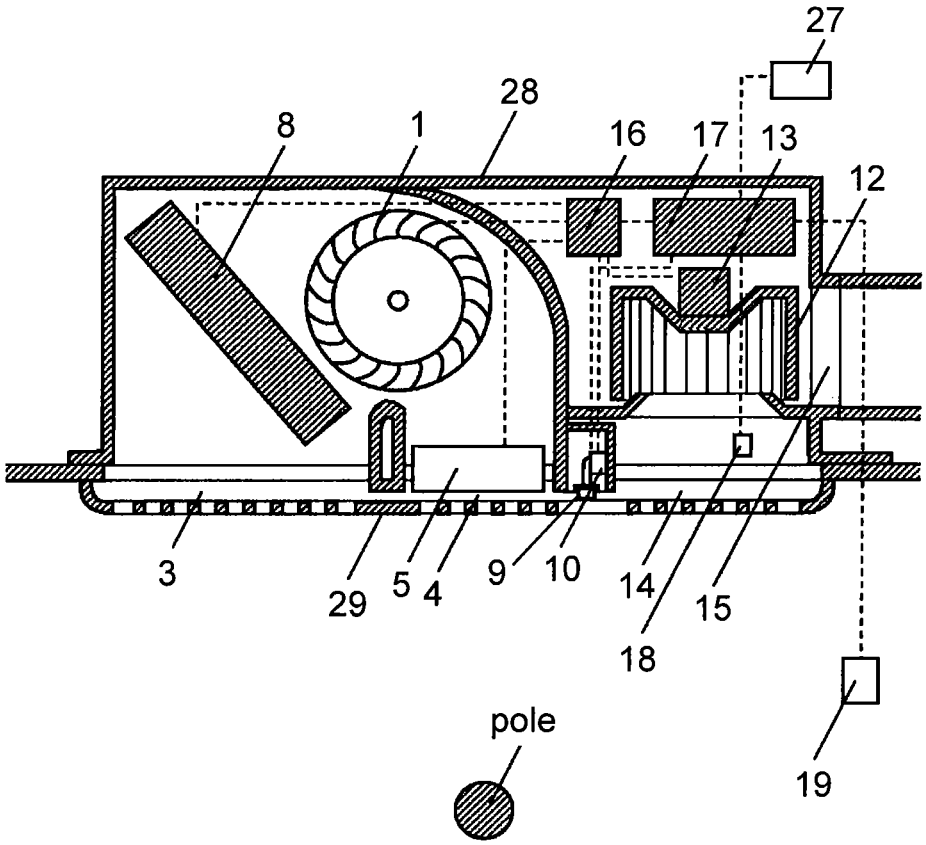
FIG. 1 shows a sectional view of a clothes-dryer in accordance with a first embodiment of the present invention.

1 blower fan
2, 6, 10, 13 motor
3, 14, 207 sucking port
4, 208, 302 blow-off port
5 louver
7, 11 arm
8 heater
9 infrared sensor
12 ventilation fan
15 discharge port
16 controller
17 microprocessor
18 humidity sensor
19 operating panel
20 time input button
21 time display panel
22 power switch
23 operation switch
24 mode selection switch
25 information display panel
26 display change switch
27 watt-hour meter
28 housing
29 decorative panel
201 main unit
202 bath
203 bathtub
204 ceiling
205 blower
206 controller
209, 307 louver device
210, 305 rotary shaft
211 holder
212, 304 driver
213, 306, 306*a*, 306*b* flap
214, 303 louver
215 center louver
216 midway louver
217 end louver
218, 314 assistant flap
219 rotary shaft for assistant flap
220 driver for assistant flap
221 assistant flap holder
222 pivot stopper
223 guide wing
224 rotating device
226 infrared sensor
227 heat source
301 clothes dryer
308 diffusion open side
309 concentration open side
310 to-and-fro motion time controller
311 to-and-fro motion angle controller
312 regulator
313 positioning device
315 air duct in main unit

DETAILED DESCRIPTION OF PREFERRED EMBODIMENTS

Exemplary embodiments of the present invention are demonstrated hereinafter with reference to the accompanying drawings.

Embodiment 1

A clothes-dryer is placed behind a ceiling, and at least one pole is prepared in a room for hanging clothes. The clothes dryer dries the clothes hung on the pole. The clothes dryer is typically placed in a bath; however, it can be placed in a dressing room, a sauna bath, an exclusive room for drying clothes, a room not in-use, or a corridor. Whatever the room is, assume that the clothes dryer is placed behind the ceiling of that room, and the pole is available approx. 25-30 cm below the clothes dryer. Multiple clothes are hung on the pole with the aid of hangers or the like within a range where the air blown from the dryer can reach the clothes, e.g. within 1 (one) meter from the clothes dryer.

First, a structure of the clothes dryer is demonstrated hereinafter with reference to FIG. 1 which shows a sectional view of the clothes dryer in accordance with the first embodiment of the present invention. In FIG. 1, the pole is placed depthwise from the front side to the deep side of the sheet of FIG. 1.

The clothes dryer comprises the following elements: blower fan 1 as a blower, motor 2 (not shown), sucking port 3 for sucking air from the room, blow-off port 4 for blowing the air into the room.

Blower fan 1 forms a cross-flow fan because it can blow air to a wide area; however, it forms a sirocco fan. Whichever the fan is, blower fan 1 is made of metal. In a case of using the cross-flow fan, the clothes dryer is placed such that the rotary shaft of the fan can agree with the axial direction of the pole. When blower fan 1 and motor 2 are selected, it is desirable to obtain an air volume of, e.g. 100-400 $m^3/h$, however, a greater air volume is preferable for drying the clothes within a short time and with the energy being saved unless it incurs a noise problem. Motor 2 forms a DC motor so that the rpm of blower fan 1 can be changed.

The clothes dryer is equipped with a louver device at blow-off port 4, and the louver device is formed of louvers 5 for changing a blowing direction, motor 6 (not shown), and an arm. Louvers 5 can change the blowing direction along the axial direction of the pole. Motor 6 forms a stepping motor.

Figure 2A:
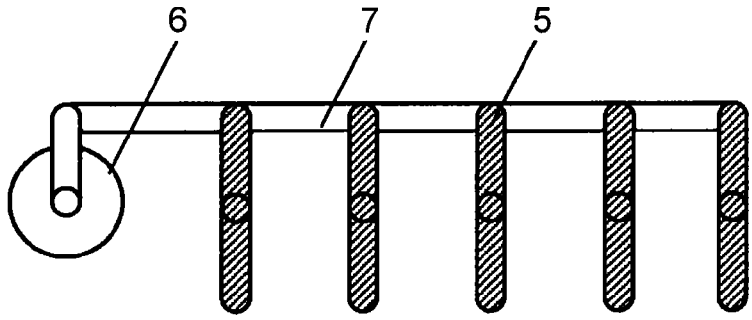
FIG. 2A shows a sectional view illustrating a structure of louvers blowing air below the clothes dryer.
Figure 2B:
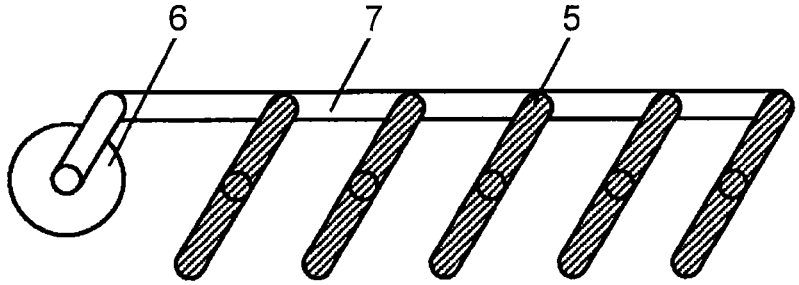
FIG. 2B shows a sectional view illustrating a structure of the louvers blowing air slantingly under the clothes dryer.

The operation of louvers 5 is demonstrated hereinafter with reference to FIG. 2. FIG. 2A shows a sectional view of a structure of louvers 5 which blow air under the clothes dryer in accordance with the first embodiment. FIG. 2B shows a sectional view of a structure of louvers 5 which blow air slantingly below the clothes dryer.

Louvers 5 connected via arm 7 to motor 6 which spins along the axial direction of the pole, and the spin of motor 6 allows each one of louvers 5 to slant together in the same direction as shown in FIG. 2B. This structure allows changing a direction of air so that each piece of the clothes can catch the air blow.

The clothes dryer is also equipped with heater 8 as a heat source in an air duct of blower fan 1. Heater 8 forms, e.g. PTC heater of 1000-2000 watt; however, a hot-water pipe of a gas water heater can be laid instead.

The clothes dryer includes infrared sensor 9 as a surface temperature sensor, motor 10 as a sensing direction changer and as a direction sensor for sensing a direction of a sensing target, and the dryer also includes an arm described later in FIG. 3.

Infrared sensor 9 forms, e.g. a thermopile suitable for sensing a surface temperature of a static object, and the thermopile employs a small view angle, e.g. 3 degrees, in order to measure a radiation temperature in a small area. Infrared sensor 9 senses a temperature with the aid of thermistor, which works as a temperature sensor. Use of compound eye in infrared sensor 9 allows sensing multiple areas simultaneously, thereby accurately sensing the clothes not-yet dried; however, a thermopile with an inexpensive single eye is used in this embodiment. Motor 10 forms, e.g. a stepping motor.

Figure 3A:
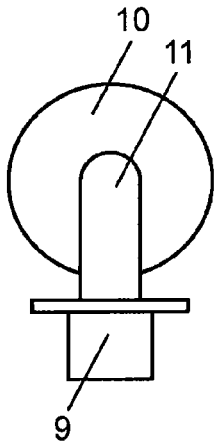
FIG. 3A shows an elevation view of an infrared sensor which senses something below the clothes dryer.
Figure 3B:
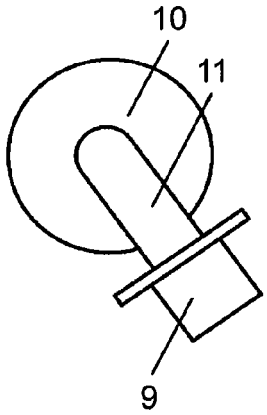
FIG. 3B shows an elevation view of the infrared sensor which senses something slantingly under the clothes dryer.

An operation of changing a direction of sensing a radiation temperature is demonstrated hereinafter with reference to FIG. 3. FIG. 3A shows an elevation view illustrating a state where an infrared sensor senses something under the clothes dryer in accordance with the first embodiment. FIG. 3B shows an elevation view illustrating a state where the infrared sensor senses something placed slantingly under the clothes dryer.

Infrared sensor 9 is rigidly mounted to motor 10 via arm 11 such that it rotates together with motor 10 that rotates along the axial direction of the pole. This structure allows sensor 9 to rotate along the axial direction of the pole, so that sensor 9 can senses surface temperatures of multiple pieces of the clothes.

Subjected to an highly humid environment, infrared sensor 9 shortens its service life, so that it is preferable to protect sensor 9 with some cover against the humidity produced while someone takes a bath. The detail of the cover is omitted here.

As shown in FIG. 1, the clothes dryer comprises the following elements: ventilation fan 12 for discharging the air from the room to the outside, motor 13, sucking port 14 for sucking the air from the room, and discharge port 15 for discharging the air to the outside. Ventilation fan 12 forms a sirocco fan because it can maintain an air volume even when a pressure is needed for sucking the air. If a ventilation device strong enough to evacuate the humidity from the room is available in the room besides the foregoing elements, the clothes dryer does not always need ventilation fan 12, motor 13, sucking port 14 or discharge port 15.

The clothes dryer is equipped with controller 16 which works as a control device connecting with motors 2, 6, 10, 13 and heater 8 for controlling their operations.

The clothes dryer is equipped with microprocessor 17 which works as a drying predictor, a heat indication device, a memory device, and a timer. Microprocessor 17 issues commands to controller 16 for predicting a dry-end time based on information from infrared sensor 9, giving heater 8 an instruction at what time heater 8 should start heating, determining whether or not the clothes are dried, and for storing data of how long it takes to dry the clothes. The flows of calculation and determination done by microprocessor 17 are detailed later.

The clothes dryer is equipped with humidity sensor 18 as a relative humidity sensing device. Humidity sensor 18 is placed in a circulation duct of the dryer for sensing a humidity of the discharged air as a humidity of the air around the clothes. Sensor 18 connects with microprocessor 17, thereby sending information about the sensed humidity to microprocessor 17. Sensor 18 is made of polymer membrane excellent in responsiveness, and it can sense a humidity as wide as 0-100%. Microprocessor 17 has a circuit that can calculate an absolute humidity based on the temperature information sent from infrared sensor 9 and the relative humidity information sent from humidity sensor 18, so that microprocessor 17 can work as an absolute humidity sensor.

Figure 4:
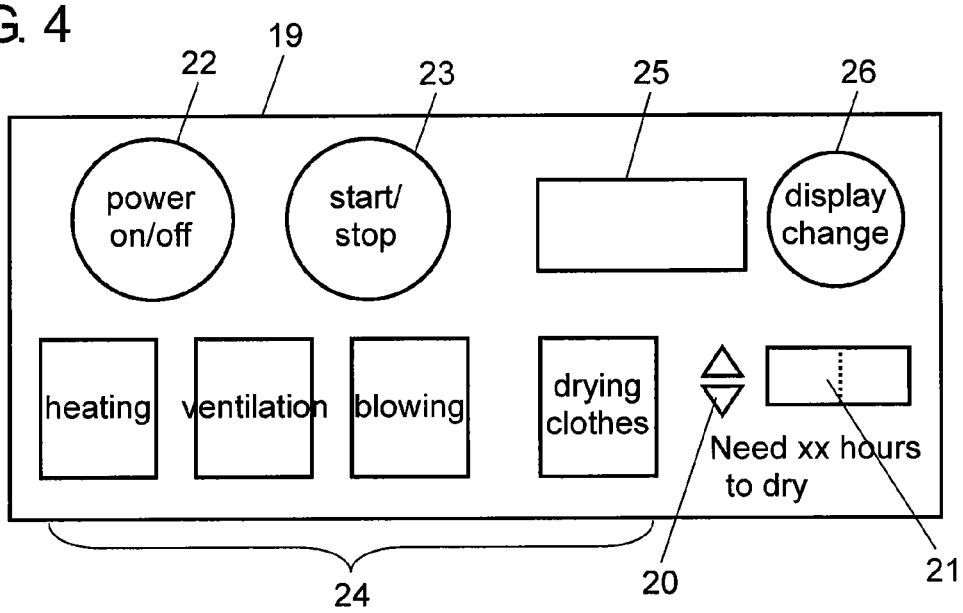
FIG. 4 shows a plan view illustrating an operating panel of the clothes dryer.

The clothes dryer includes operating panel 19 for a user to operate the clothes dryer. Operating panel 19 is demonstrated hereinafter with reference to FIG. 4 which shows a plan view of the operating panel.

Operating panel 19 comprises the following elements: time input button 20 working as a time input device, time display panel 21, power switch 22, operation switch 23, mode selection switch 24, information display panel 25, and display change switch 26. A user inputs his/her desirable dry-end time as a target dry-end time through time input button 20. The supplied target dry-end time is displayed on time display panel 21 adjacent to button 20. Information display panel 25 displays an electric energy, discharge amount of $CO_2$, or a running cost. Display change switch 26 allows alternating the displays of those data.

Operating panel 19 connects with microprocessor 17, and the information from time-input button 20, power switch 22, operation switch 23, and mode selection switch 24 are supplied to microprocessor 17. Information display panel 25 receives the information from microprocessor 17 about the electric energy, the discharge amount of $CO_2$, and the running cost.

The clothes dryer includes watt-hour meter 27 as a measuring device for electric energy. Meter 27 connects with microprocessor 17, to which the information about the measured electric energy is sent from meter 27. Microprocessor 17 has a conversion function that converts the electric energy into a discharge amount of $CO_2$ and a running cost, so that microprocessor 17 also works as a converter to a discharge amount of $CO_2$ and a converter to a running cost.

The clothes dryer includes housing 28 made of metal or resin, and decorative panel 29 made of resin. Housing 28 is placed behind the ceiling.

Figure 5:
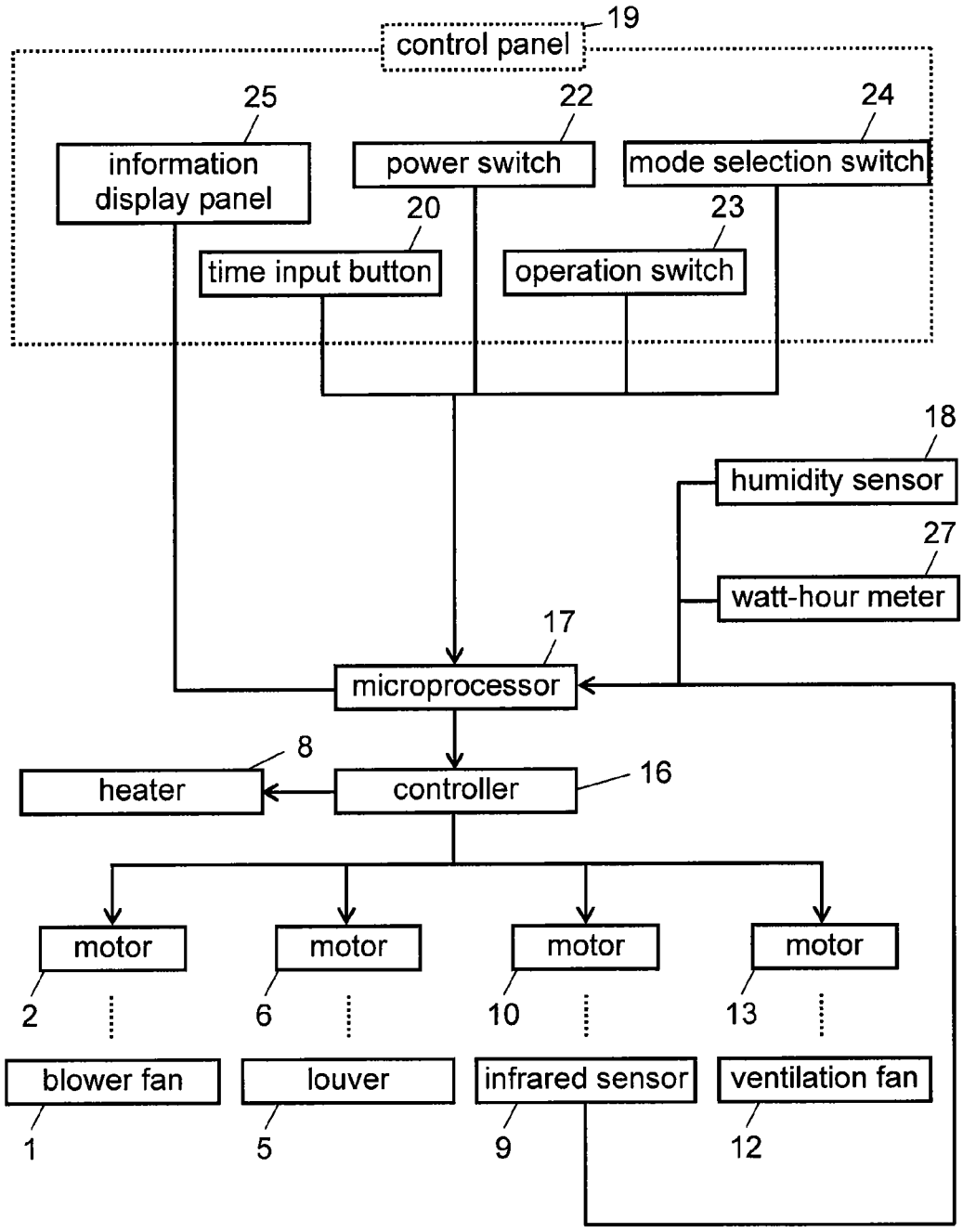
FIG. 5 shows a block diagram illustrating flows of information among each one of structural elements of the clothes dryer.

The relations among each one of the foregoing elements are shown in FIG. 5, which shows the flows of information among the respective elements of the clothe dryer in accordance with the first embodiment. Each piece of information gathers into microprocessor 17, which then issues commands through controller 16 about the operation of the clothes dryer.

Figure 6:
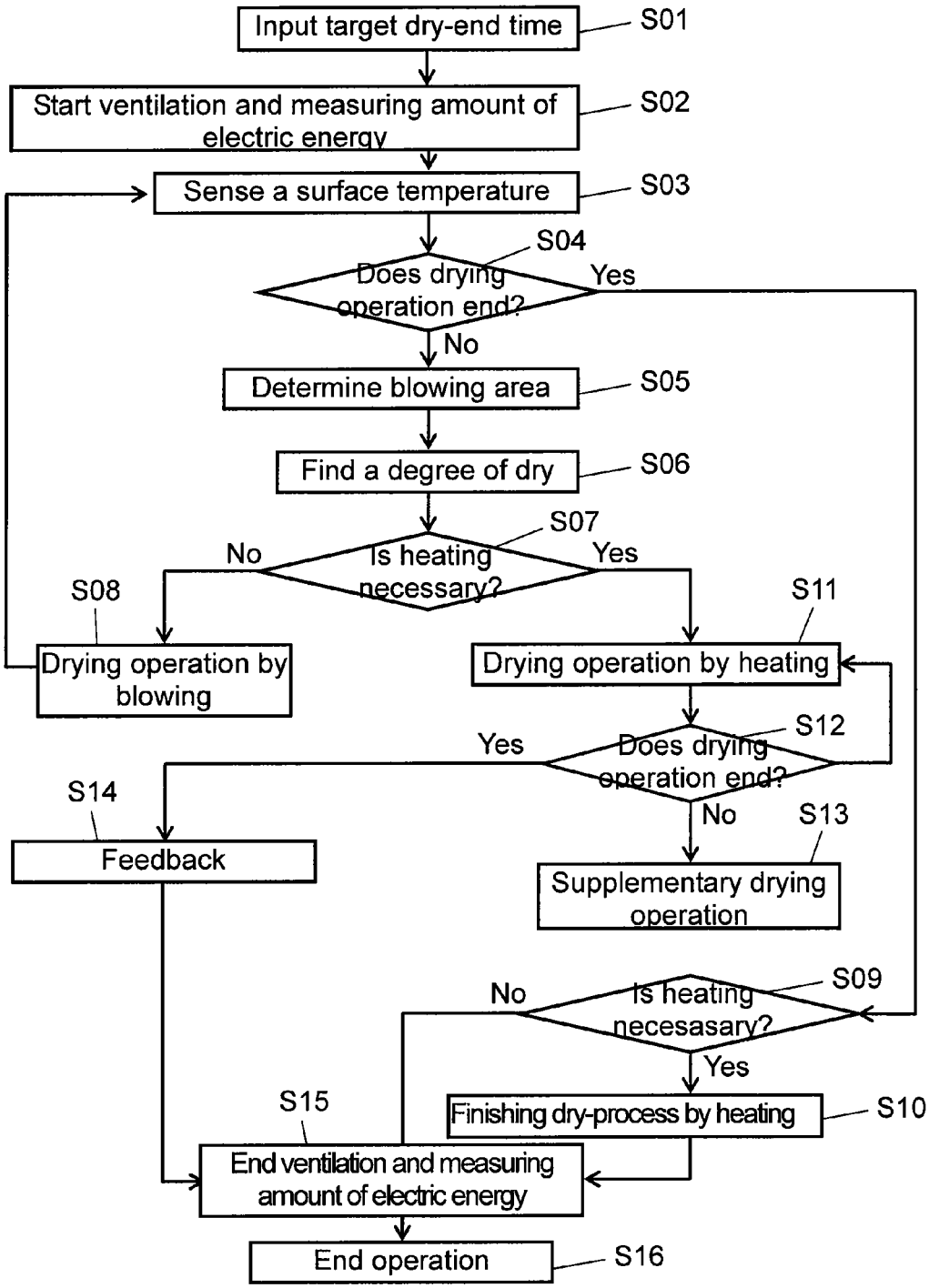
FIG. 6 shows a flowchart illustrating an operation of the clothes dryer when a clothes-drying mode is selected.

Next, the operation of the clothes dryer is outlined with reference to FIG. 6, which shows a flowchart illustrating a case when a clothes-drying mode is selected in the clothes dryer in accordance with the first embodiment.

Besides the clothes-drying mode, other modes such as a heating mode, ventilating mode, blowing mode are available on the clothes dryer, and a user can select one of those modes with mode selection switch 24. The operations of the modes other than the clothes-drying mode are omitted here.

First a user turns on the dryer and selects the clothes drying mode, and then inputs a target dry-end time (S01), which prompts microprocessor 17 to start ventilation and measurement of electric energy (S02) before starting the sensing of a surface temperature of the clothes (S03). Next, microprocessor 17 determines whether or not the drying operation of the clothes ends (S04). In the case where the dry operation ends, microprocessor 17 determines whether or not heating is necessary (S09). When the heating is needed, it is done (S10) before the ventilation is stopped (S15), and finally the operation ends (S16). When the drying operation is not finished yet, a place where wet clothes exist is specified for determining an area to which air should be blown (S05). Then a degree of dryness in the wet clothes is determined based on the result in step S03 (S06).

Next, based on the degree of dryness and the target dry-end time supplied by the user, microprocessor 17 determines whether or not the heating is necessary (S07). In the case where the heating is not needed, the drying operation by only blowing is kept for a given time (S08), and then the surface temperature of the clothes is sensed again (S03). In the case where the heating is needed, the drying operation by heating and blowing is kept until the target dry-end time (S11).

When the operation reaches to the target dry-end time, microprocessor 17 determines whether or not the clothes are dried (S11). When the clothes are not dried yet, supplemental dry operation by heating and blowing is done for a given time (S13). When the clothes are dried, the result is fed back (S14) before the circulation and the measurement of electric energy are finished (S15). Then the operation ends (S16).

As discussed above, the clothes dryer stops its operation automatically when the clothes are dried, so that it never happens that the clothes are not dried yet as is happened in the operation set with a timer. The clothes dryer also prevents the clothes from being over-dried, so that energy is never wasted. The clothes dryer also completes drying the clothes within a time desired by a user, so that the user needs not care about wasting energy. The user can dry the clothes according to his or her own life style. The clothes dryer can also decrease the load on environment.

The wet clothes in this context refer to as the clothes that do not agree with environmental atmosphere. In other words, the dried clothes are defined as this: when they are placed in the environmental atmosphere, their degree of dryness reaches the equilibrium moisture content, and the degree of dryness of the wet clothes does not reach it.

Respective steps of the dry operation are detailed hereinafter. First of all, step S02, which starts the ventilation and the measurement of electric energy, is demonstrated hereinafter. Receiving the information that the clothes-drying mode is selected with mode selection switch 24, microprocessor 17 gives controller 16 a command to start the ventilation. Controller 16 operates motor 13 for driving ventilation fan 12, thereby discharging the air from the room to the outside. Assume that the ventilation air volume is 100-200 $m^3$/h based on the use of a bath for installing the clothes dryer. When a larger room is used, a greater ventilation air volume is needed. The ventilation is kept going in S02 through S14. At this time, microprocessor 17 starts measuring the electric energy with watt-hour meter 27.

Figure 7:
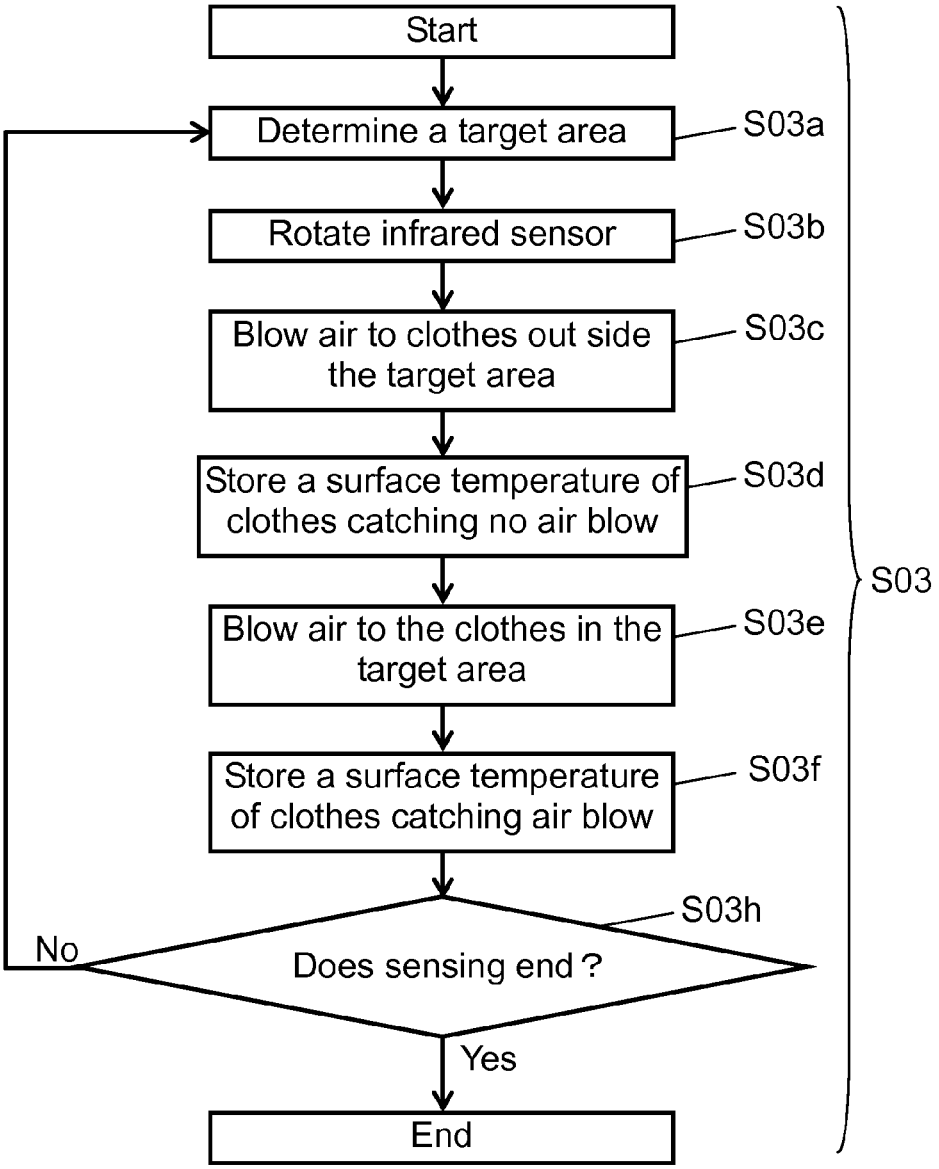
FIG. 7 shows a flowchart illustrating control over sensing the surface temperature of the clothes (S03).

Next, sensing the surface temperature of the clothes (S03) is detailed with reference to FIG. 7, which shows a flowchart of controlling the surface temperature sensing (S03) done by the clothes dryer in accordance with the first embodiment.

Start of S03 prompts microprocessor 17 to determine an area to be sensed (S03*a*). The entire area to be sensed is referred to as a sensing area, and each one of divided areas of the sensing area is referred to as a divisional area. A specific divided area to be sensed occasionally is referred to as a target area. The reason why the sensing area is divided is to comprehensively understand the degree of dryness of the clothes hung widely on the pole. For this purpose, the around-pole-space, where the clothes are expected to exist, is divided into multiple divisional areas along the axial direction of the pole, and microprocessor 17 stores the divisional areas in advance. Microprocessor 17 selects one of the divisional areas as a target area one by one.

Figure 8:
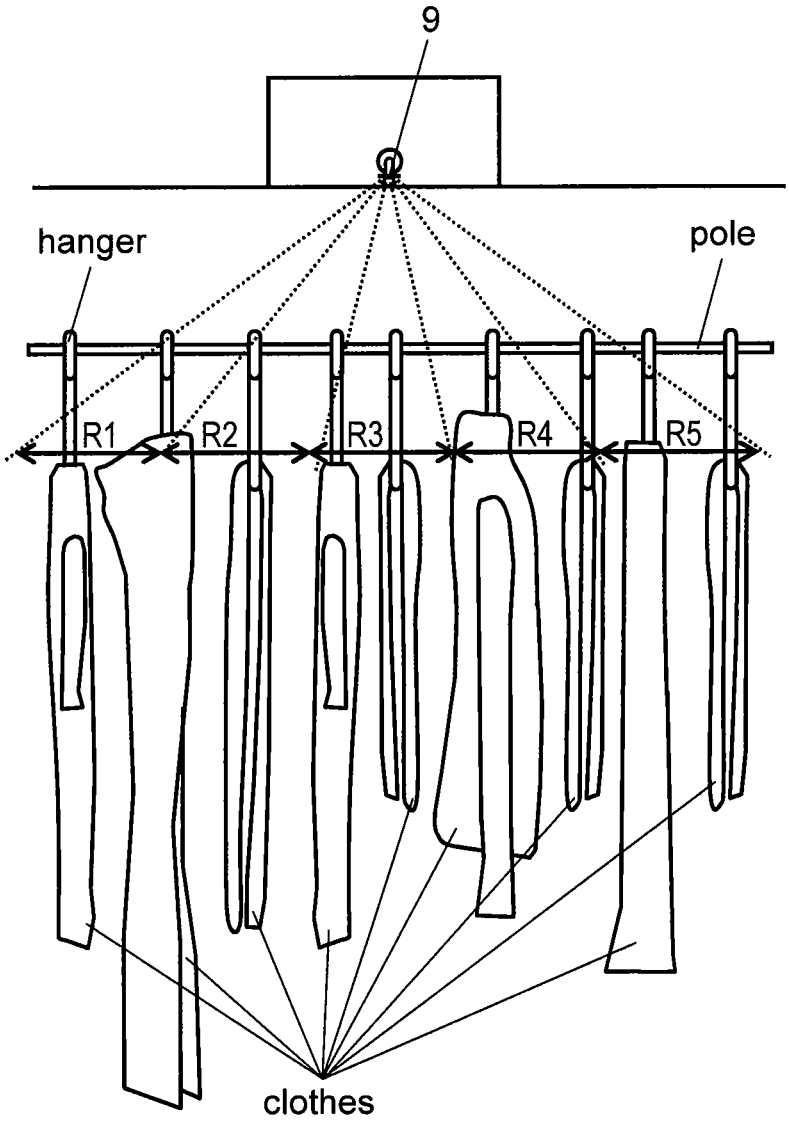
FIG. 8 schematically shows a method of dividing a target sensing area of the clothes dryer.

The division of the sensing area is demonstrated more specifically with reference to FIG. 8, which schematically illustrates the method for dividing the sensing area. A length of the pole is not specified here; however, the length desirably defines a range within which the surface temperature can be sensed, e.g. 1 (one) meter. In other words, the air blown from the dryer can reach within this range.

According to the method, the sensing area is divided into a given number, e.g. 5, of divisional areas. FIG. 8 shows that the sensing area is divided into 5 divisional areas, i.e. R1-R5, and a degree of dryness is determined for each one of the divisional areas.

Microprocessor 17 determines a target area from areas R1-R5 (S03*a*), and then instructs controller 16 to spin motor 10, thereby rotating infrared sensor 9, which thus can be ready to sense the surface temperature of the clothes existing in the target area (S03*b*).

Microprocessor 17 then instructs controller 16 to spin motor 6, thereby starting the blow of air to the divisional areas other than the target area (S03*c*). The steps of S03*b* and S03*c* can be done simultaneously or in reverse order. In a given time, e.g. one minute has passed, microprocessor 17 temporarily stores the temperature sensed by infrared sensor 9 as a surface temperature of the clothes that catch no air (S03*d*).

When the surface temperature of the clothes that catch no air blow is sensed, the air can be blown to other clothes, so that the drying operation can be kept without halting the air-blowing during the temperature sensing. As a result, a drying time can be further shortened. In this case, the air is preferably blown to remote areas, where the clothes are expected to exist, from the target area. In the case of dividing the sensing area into 5 divisional areas as shown in FIG. 8, blow the air to area R4 when area R1 is sensed, or blow the air to area R5 when area R2 is sensed, or blow the air to area R1 or R5 when area R3 is sensed.

As discussed above, the surface temperature is stored temporarily in a given time after the target area is fixed. During this given time, the temperature of the clothes is expected to become stable. If the air is blown to the clothes in the target area just before the sensing, the clothes is at a low temperature because they have caught the air blow. When the blowing of the air is halted, the clothes' temperature approaches a temperature of the clothes that catch no air blow; however, since the clothes have a heat capacity, the temperature does not rise immediately. Considering this fact, the clothes in the target area are kept from catching the air blow for a given time, e.g. one minute, before the sensing. This preparation allows sensing accurately the surface temperature of the clothes that catch no air blow. The foregoing process can be applied to the state where the clothes catch the air blow.

Since the surface temperature sensed by infrared sensor 9 is a variable, the temperatures sensed for a given time, e.g. 10 seconds, are time-averaged to be stored in microprocessor 17. When storing the surface temperature, microprocessor 17 also stores the following data: positional information about the target area, which is obtained as a rotation angle of motor 10, and a condition about availability of the air, which is obtained as a difference in rotation angle between motor 6 and motor 10.

Then microprocessor 17 blows the air to the clothes in the target area (S03*e*), and senses the surface temperature of the clothes catching the air blow by the same method as described in step S03*d* (S03*f*).

Before blowing the air to the clothes in the target area, microprocessor 17 gives controller 16 a command to spin motor 6 so that louvers 5 can be directed toward the clothes in the target area. The rotation angles of motors 6 and 10 should be adjusted in advance so that the air can blow to the target area sensed by infrared sensor 9. The adjusted rotation angles should be stored in microprocessor 17.

If the air blows weakly, the surface temperature sometimes cannot lower sufficiently, and if the air blows strongly, the clothes in the target area flutter so much in the air that the surface temperature sometimes cannot be measured accurately. The air blown to the clothes thus should be adjusted to 0.5-2.0 m/sec on the clothes' surface nearest to the clothes dryer when the surface temperature is sensed. This adjustment allows appropriately sensing the surface temperature of the clothes catching the air blow.

Since the clothes relatively near to blow-off port 4 catch strong air blow while the clothes relatively remote from blow-off port 4 catch weak air blow, the force of the air blow can be changed depending on the distance from blow-off port 4 so that the clothes can catch the air at a constant force level.

Microprocessor 17 finally determines whether or not the surface temperatures of the clothes in all the divisional areas are sensed (S03*h*), and when the temperatures of some clothes are not sensed yet, the step returns to the step S03*a* where the next target areas are set, and when the clothes in all the divisional areas have been sensed, the step S03 ends.

Before the step S04 is demonstrated, the reason is described hereinafter why the difference in surface temperature between the clothes catching the air blow and the clothes catching no air blow can be a ground for determining a dry-end in a piece of the clothes. A temperature difference between a dry surface and a wet surface of an object is caused by the moisture existing on the surface because the moisture evaporates depriving the surface of latent heat due to vaporization. From the wet surface the moisture evaporates even if the surface catches no air blow; however, the evaporation is accelerated when the surface catches air blow, so that the surface temperature lowers the more. When the dry surface catches air blow, the surface temperature thereof never lowers except the temperature of the air or the air blow is lower than the surface temperature. The difference discussed above thus allows determining that the clothes are dried when there is no difference in surface temperature between the clothes catching air blow and the clothes catching no air blow.

Next, the determination (S04) of whether or not the clothes have been dried is demonstrated hereinafter. In previous step S03, microprocessor 17 has stored the surface temperatures of the clothes catching air blow and catching no air blow in all the divisional areas. In a case where no wet clothes remain in any divisional area, microprocessor 17 determines that the clothes have been dried. The criterion for this determination is, as discussed above, the presence of a difference in surface temperature between the clothes catching air blow and the clothes catching no air blow. If the difference falls within a given range, e.g. 0.2 K, which should be stored in microprocessor 17 in advance, the clothes in the divisional area are determined as dried ones.

When microprocessor 17 determines that the clothes have been dried, the step moves on to step S14. When the clothes are not dried yet, the divisional area where the wet clothes remain is stored in microprocessor 17, and the step moves on to S05. The steps to be done from step S14 and onward are described later.

Next, step S05 where an air-blowing area is determined is demonstrated hereinafter. In step S05, a control for determining the air-blowing area so that the air can be directed to the divisional area where wet clothes remain. Acceleration of a speed of drying the wet clothes will prevent the clothes from being dried unevenly, which results in a shorter drying time. The shorter drying time not only satisfies users' needs but also decreases the environmental load because the energy can be saved.

The air-blowing area defines divisional areas, where the wet clothes remain, with the first end of the areas and the second end of the areas. For instance, as shown in FIG. 8, when the wet clothes remain in divisional areas R1 and R3 among divisional areas R1-R5, then it is determined that the air should blow to areas R1-R3.

Before entering into the description of step S06, the reason is described hereinafter why a difference in surface temperature between the clothes catching air blow and the clothes catching no air blow can be a ground for determining a degree of dryness in the clothes.

Figure 9A:
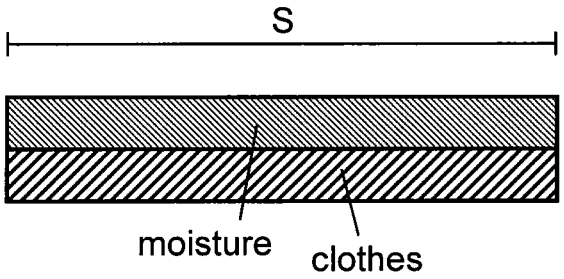
FIG. 9A schematically shows moisture state on the clothes surface during a constant rate drying period.
Figure 9B:
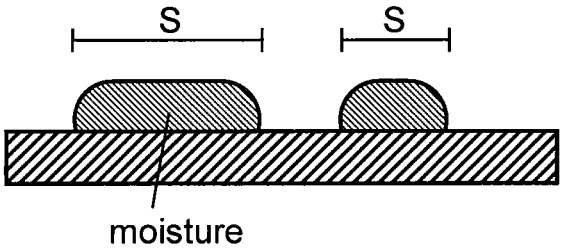
FIG. 9B schematically shows moisture state on the clothes surface during a falling rate drying period.

There are known periods in a degree of dryness in the clothes, i.e. a constant rate drying period where a given amount of moisture keeps evaporating, and a falling rate drying period where an amount of moisture evaporating decreases. The moisture existing on the clothes' surface is described with reference to FIG. 9. FIG. 9A schematically illustrates the moisture existing on the surface of the clothes during the constant rate drying period, while FIG. 9B illustrates the moisture existing on the surface during the falling rate drying period.

During the falling rate drying period, the moisture exists dispersedly on the surface of the clothes. An evaporation amount (Q) of moisture is expressed by equation (1).

$$Q=\alpha'(X_r-X_{clo})S \tag{1}$$

where,

Q: amount of moisture evaporation [g/s]

$\alpha'$: humidity transmission rate [$g/m^2 \cdot s$(kg/kg')]

$X_r$: atmospheric absolute humidity [(kg/kg')]

$X_{clo}$: absolute humidity on the surface of the clothes [(kg/kg')]

S: moisture evaporating area [$m^2$]

The humidity transmission rate is a variable depending on a wind speed, and when a first piece of the clothes catches the air blow similarly to a second piece of the clothes, a wind speed occurs on the surface of the first piece of the clothes, and a similar wind speed to the first one occurs on the surface of the second piece of the clothes. Regardless of a degree of wet in the clothes, the same humidity transfer rate can be expected on the clothes that catch the air blow or on the other clothes that catch no air blow.

An atmospheric absolute humidity is a variable depending on the situation. At the early stage of drying, the atmospheric absolute humidity is high, while it lowers along the advancement of drying, and finally it becomes equal to the absolute humidity of the air supplied into the room. A degree of dryness in the clothes becomes equilibrium with the degree of dryness in the atmospheric air, so that a weight of the clothes can be kept constant. As shown in FIG. 9A, the moisture evaporating area is kept constant during the constant rate drying period; however, it decreases during the falling rate drying period along the advancement of moisture evaporation and finally it reaches 0 $m^2$ when the clothes are dried. A calculation of the moisture evaporating area allows finding a degree of dryness.

Figure 10A:
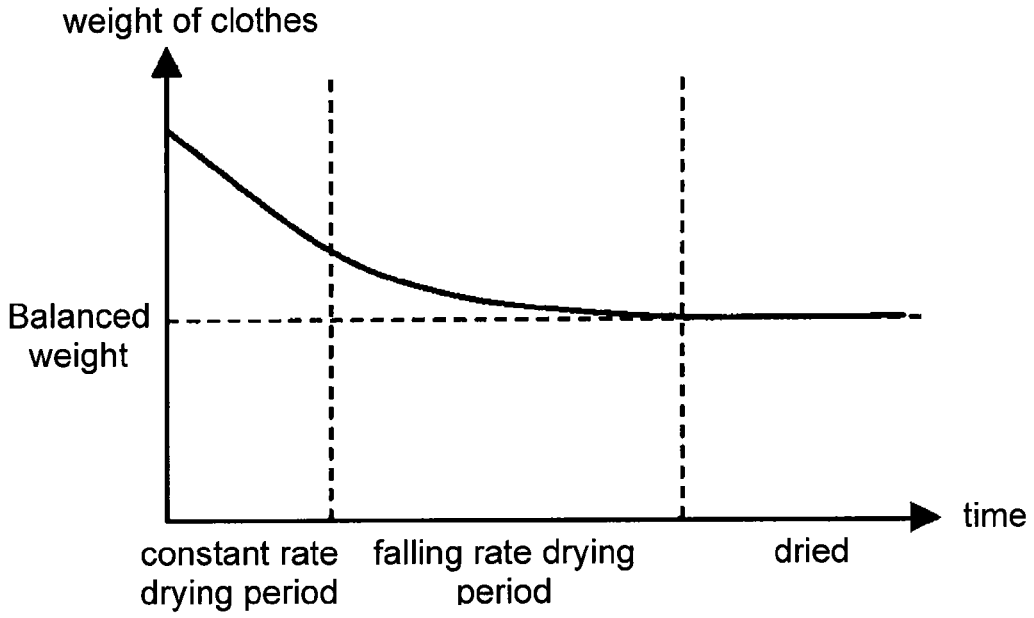
FIG. 10A shows changes in weight of the clothes in the dryer along the time.
Figure 10B:
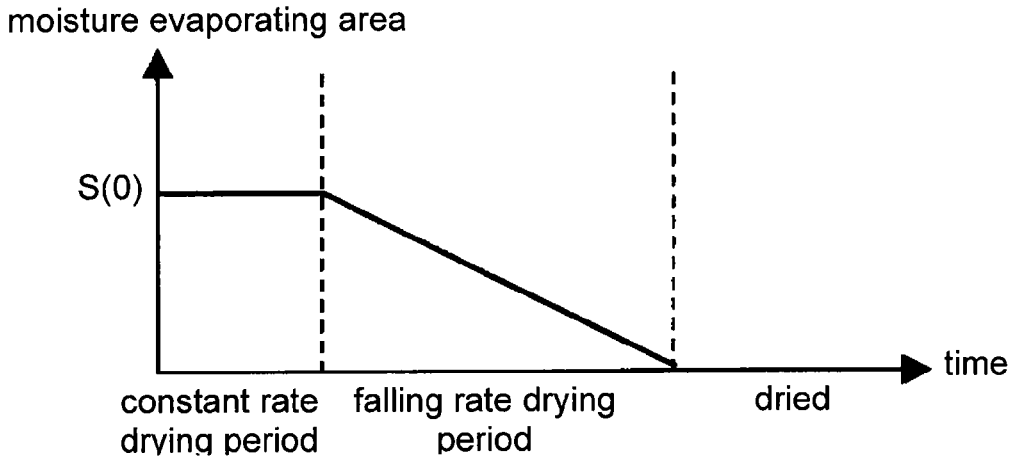
FIG. 10B shows changes in moisture evaporating area of the dryer along the time.

The relation between a weight of clothes and the moisture evaporating area is described with reference to FIG. 10. FIG. 10A shows variation with time in the weight of the clothes in the clothes dryer in accordance with the first embodiment, and FIG. 10B shows variation with time in the moisture evaporating area.

In the first stage, the clothes stay in the constant rate drying period where the moisture evaporating area is kept constant and the weight thereof decreases at a given rate. Then the clothes enter into the falling rate drying period where the moisture evaporating area decreases gradually, so that the weight decreases at a falling rate, and finally no moisture evaporating area exists, where the weight of the clothes becomes constant because no more evaporation is done into the atmospheric air.

In the case where the degree of dryness in the clothes is determined based on the difference in surface temperature between the clothes catching the air blow and the clothes catching no air blow, no erroneous determination occurs even when the clothes catch radiant heat. For instance, when the clothes not dried yet catches sunlight, the surface temperature possibly rises to the same temperature of the dried clothes or even rises higher than that temperature. In such a case, a comparison between the surface temperature and a room temperature possibly results in the determination that the clothes have been dried. However, determination based on the difference in surface temperature between the clothes catching air blow and the clothes catching no air blow results in right determination on the degree of dryness because if the clothes catch radiant heat, the air blowing to the clothes will lower the surface temperature in response to the degree of dryness.

Next, finding a degree of dryness (S06) in the clothes is demonstrated hereinafter. The moisture evaporating area discussed above is needed for finding the degree of dryness. First, a method for finding a moisture evaporating area S(t) at time (t) is demonstrated below. The moisture evaporating area S(t) of the clothes catching no air blow can be found by the following equation (2):

$$S(t) = \frac{Q_c(t)}{\alpha'_c(X_r(t) - X_{clo,c}(t))} \tag{2}$$

where,

S(t): moisture evaporating area [$m^2$]

$Q_c(t)$: amount of moisture evaporation from clothes catching no air blow [g/s]

$\alpha_c'$: humidity transmission rate of clothes catching no air blow [$g/m^2 \cdot s(kg/kg')$]

$X_{clo,c}$: absolute humidity on the surface of clothes catching no air blow [(kg/kg')]

Microprocessor 17 stores in advance a given value, e.g. 5.8 $g/m^2 \cdot s$ (kg/kg') as humidity transmission rate $\alpha_c'$. Microprocessor 17 calculates the atmospheric absolute humidity $X_r(t)$ by using a temperature sensed by the thermistor of infrared sensor 9 and a relative humidity sensed by humidity sensor 18. Microprocessor 17 also calculates the absolute humidity $X_{clo,\ c}(t)$ on the surface of clothes as an absolute humidity in the case of relative humidity being 100% at the surface temperature sensed by infrared sensor 9. An amount of moisture evaporation $Q_c(t)$, when the clothes catch no air blow, relates to the surface temperature of clothes; however, $Q_c(t)$ is unknown at this moment.

Next, moisture evaporating area $S_w(t)$ of the clothes catching air can be found by following equation (3).

$$S_w(t) = \frac{Q_w(t)}{\alpha'_w(X_r(t) - X_{clo,w}(t))} \tag{3}$$

where, $Q_w(t)$: amount of moisture evaporating from clothes catching air blow [g/s]

$\alpha_w'$: humidity transmission rate of clothes catching air blow [$g/m^2 \cdot s(kg/kg')$]

$X_{clo,\ w}$: absolute humidity on the surface of clothes catching air blow [(kg/kg')]

Microprocessor 17 stores in advance a given value, e.g. 9.7 $g/m^2 \cdot s$ (kg/kg') at an air speed of 1.0 m/sec as humidity transmission rate $\alpha w'$.

Atmospheric absolute humidity $X_r(t)$ and absolute humidity on the surface of clothes $X_{clo,w}(t)$ can be calculated in the same manner as calculated for the clothes catching no air blow.

Microprocessor 17 calculates a difference in amounts of moisture evaporation between the clothes catching air blow and the clothes catching no air blow by using equation (4).

$$Q_w(t) - Q_c(t) = k(T_w(t) - T_c(t)) \tag{4}$$

where, $T_w(t)$: surface temperature of clothes catching blow air [° C.]

$T_c(t)$: surface temperature of clothes catching no air blow [° C.]

k: coefficient

Coefficient (k) is not fixed here. Equation (4) indicates that the difference in the amounts of moisture evaporation between the clothes catching air blow and the clothes catching no air blow is proportional to a difference in surface temperature between the clothes catching air blow and the clothes catching no air blow. Because a greater amount of moisture evaporation deprives the surface of latent heat of vaporization the more, and the surface temperature thus lowers.

Surface temperature Tw(t) of the clothes catching air blow and surface temperature Tc(t) of the clothes catching no air blow are obtained as the surface temperatures sensed by infrared sensor 9. Finally, microprocessor 17 can find moisture evaporating area S(t) at time (t) by the following equation (5).

$$S(t) = \frac{k(T_w(t) - T_c(t))}{\alpha'_w(X_r(t) - X_{clo,w}(t)) - \alpha'_c(X_r(t) - X_{clo,c}(t))} \tag{5}$$

Microprocessor 17 finds moisture evaporating area S(0) at the first time, then stores S(0) for each one of the divisional areas. When microprocessor 17 finds moisture evaporating area S(t) at the second time and onward, it calculates the ratio of S(t) vs. S(0) as a degree of dryness in the clothes for each one of the divisional areas.

Next, the determination (S07) whether or not heating is needed is described hereinafter. In the case of drying the clothes in an energy-saving manner, it is preferable to dry the clothes without using heater 8; however, when a user wants to dry the clothes urgently, it had better use heater 8. In this case, the user can anticipate from user's experience how long heater 8 should be used for drying the clothes with the energy being saved as much as possible within his or her target dry-end time. However, this anticipation includes some error. Monitoring a degree of dryness in the clothes, the clothes dryer of the present invention can determine whether or not heater 8 should be used, so that the dryer can meet the user's need for drying the clothes within a desirable time while the dryer can dry the clothes in the utmost energy saving manner.

Figure 11A:
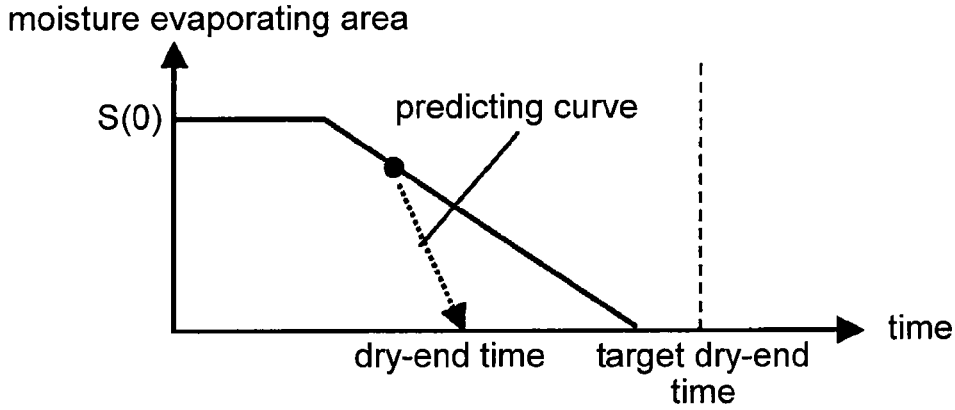
FIG. 11A shows a state where a dry-end time arrives earlier than a target end-time.
Figure 11B:
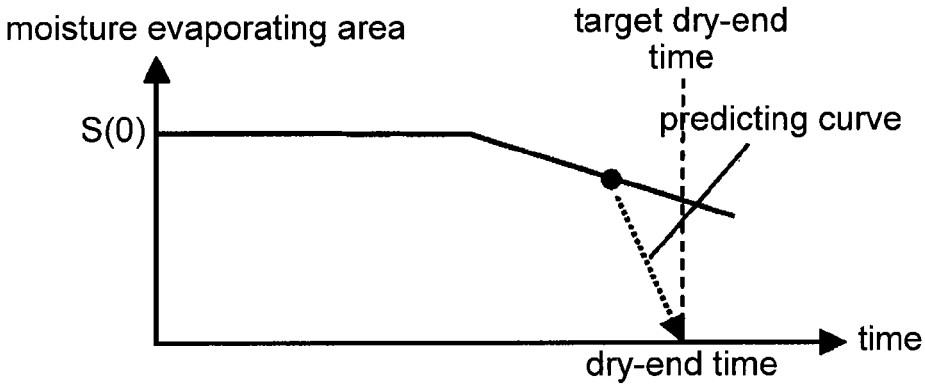
FIG. 11B shows a state where a dry-end time is similar to a target-end time.
Figure 11C:
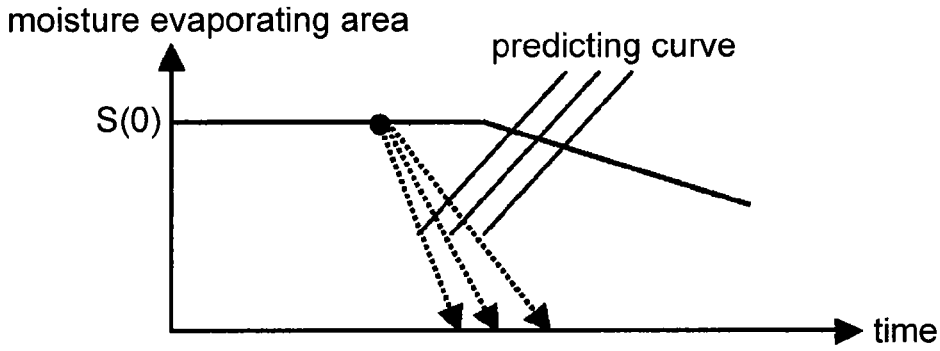
FIG. 11C shows multiple predicting-curves of the clothes dryer.

Microprocessor 17 determines whether or not the heating is needed based on the comparison between a predicted dry-end time with the aid of heater 8 from the determination point and a target dry-end time. The predicted dry-end time is described hereinafter with reference to FIG. 11. FIG. 11A shows a graph in which the predicted dry-end time comes earlier than the target dry-end time, while FIG. 11B shows a graph in which the predicted dry-end time comes nearly at the same time as the target dry-end time. FIG. 11C shows a graph in which multiple predicting curves of the clothes dryer in accordance with the first embodiment are available.

In step S06, since moisture evaporating area S(t) at time (t) has been found as a degree of dryness in the clothes, a predicting curve is drawn assuming that heater 8 is used from the time (t), and the time until the moisture evaporating area reaches 0 $m^2$ is predicted as a dry-end time. This predicting curve can be experimentally found in advance based on the relation between the moisture evaporating area and the time in the case of using heater 8, and this predicting curve has been stored in microprocessor 17. The curve is variable depending on a heating amount and a manner of blowing air.

In the case of FIG. 11A, i.e. where the dry-end time comes earlier than the target dry-end time, the clothes can possibly be dried by the target dry-end time without heating, so that microprocessor 17 determines then that no heating is needed.

In the case of FIG. 11B, i.e. where the dry-end time comes approx. at the same time as the target dry-end time, the clothes will not be dried without heating by the target dry-end time, so that microprocessor 17 determines then that heating is needed.

In the case of FIG. 11C, i.e. the duration of heating from the start until the clothes are dried varies depending on the humidity in the room because of the following reason: When the heating starts, the clothes are warmed at some sections catching the heated air blow, and at the same time the absolute humidity of the room lowers, so that the clothes are accelerated to dry at the other sections where no heated air blows directly. The reason why the absolute humidity of the room lowers is this: The temperature of the room rises, and discharged air contains a greater amount of moisture at the same ventilation amount hitherto used. The rise in the room temperature is influenced by an initial temperature. To be more specific, in the summer where the room temperature stays at a rather higher degree from the beginning, so that when the heating starts and the room temperature rises slightly, then a saturated humidity increases greatly at once. However, in the winter, where the room temperature stays at a low degree from the beginning, and although the heating starts and the room temperature rises a bit, the saturated humidity will not increase so much.

Considering the fact discussed above, multiple predicting curves based on temperatures are desirably prepared as shown in FIG. 11C, where three curves are prepared, for obtaining more accurate determination on whether or not the heating is needed. When microprocessor 17 predicts a dry-end time in step S07, it uses the thermistor of infrared sensor 9, and the predicting curves in response to the measurement by the thermistor are used. These curves indicate, as a matter of course, that a dry-end time becomes longer at a lower room temperature, and a dry-end time becomes shorter at a higher room temperature.

In step S07, when microprocessor 17 determines that the heating is still not needed, blowing and drying operation starts (S08). This operation dries the clothes only by blowing and ventilating. Microprocessor 17 gives controller 16 a command to blow air in the air blowing area fixed in step S05, and to spin motor 6 so that wet clothes can catch the air blow. In this case, controller 16 prompts motor 6 to spin at given intervals, e.g. 0.1 s/degree, so that louvers 5 can pivot.

A greater amount of air-blow will dry the clothes sooner. The blowing and drying operation continues for a given time, e.g. 20 minutes, and after this given time has passed, the surface temperature of the clothes is sensed again (S03).

In a case where the drying operation ends without heating, microprocessor 17 determines whether or not the heating is needed (S09), in which microprocessor 17 measures a relative humidity with humidity sensor 18 when the drying operation ends. When the relative humidity exceeds a given value, e.g. 70% RH, microprocessor 17 determines that the heating is needed. In such a case, the heating and blowing are done (S10) as a finishing dry-process for a given time, e.g. 10 minutes.

Figure 12:
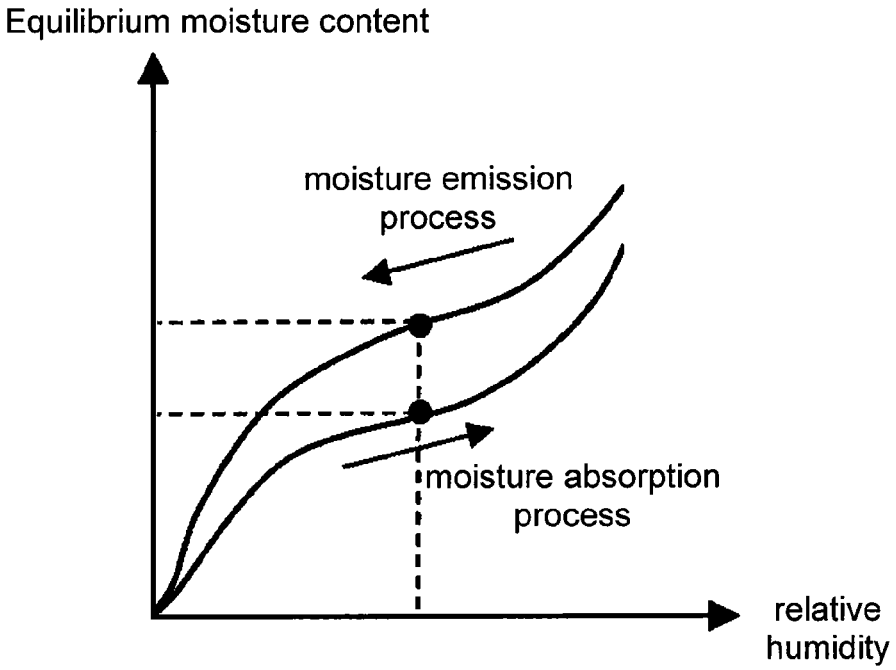
FIG. 12 shows curves of equilibrium moisture content of the clothes dryer.

There are two equilibrium states in the clothes. The relation between a relative humidity and an equilibrium moisture content of the clothes is described with reference to FIG. 12, which shows a graph of the equilibrium moisture content of the clothes dryer in accordance with this first embodiment. The equilibrium moisture content refers to the moisture contained in the clothes in an equilibrium state with the atmospheric air. It is known that the equilibrium moisture content during a moisture absorption process differs from that during a moisture emission process. This phenomenon is generally called "hysteresis", and is caused by physical resistance produced when moisture enters capillaries of the clothes.

In a case where the clothes are dried without heating, the equilibrium moisture content of the clothes is the one during the moisture emission process. In particular, when the clothes have been dried in a highly humid atmosphere without heating, the clothes have fallen in the equilibrium state with the highly humid air during the moisture emission process. When people touch the clothes in this state, they probably feel humid.

The clothes in this state are heated, so that the relative humidity around the clothes can lower, and even if the relative humidity rises again after the heating, the clothes hold the equilibrium moisture content at the moisture absorption process.

As discussed above, when the clothes have been dried without heating, the clothes can be heated as a finishing dry-process (S10) when necessary. As a result, the clothes can be in a more dried state than they have been left as they were, and the user can feel well-dry with satisfaction.

In step S07, when microprocessor 17 determines that the heating is needed, heating and drying operation starts (S11). This operation dries the clothes by heating in addition to blowing and ventilating. When the operation moves on to step S11, microprocessor 17 gives controller 16 a command to energize heater 8. A blowing method here is the same as that used in step S08. The heating and drying operation is kept going until the target dry-end time, and when it reaches the target dry-end time, microprocessor 17 instructs controller 16 to stop feeding heater 8.

In a case where the clothes are dried while they are heated, it is more efficient to provide the clothes with heat at a latter part of this drying process rather than at the beginning part of the process, because at the beginning part of the process, only the blowing can evaporate moisture in a relatively great amount. When the heat is applied to the clothes, it had better heat the clothes at once within a batch of time, because the heated air escapes due to ventilation, so that a greater energy is lost with a longer heating time.

Heat is thus applied at once to the clothes starting from the determination of the heating in steps S07 and S08 until the end of the drying process without intermission. This procedure allows the clothes to be dried efficiently with minimum energy loss during the heating which has been determined necessary, and also achieves smaller load on the environment.

Next, determination whether or not the drying process ends (S12) is described hereinafter. The operation in step S12 is basically the same as that in steps S03 and S04; however, the clothes have caught warm air blow until then, so that the clothes possibly do not agree with the atmospheric temperature yet. The determination whether or not the drying process ends thus possibly includes some error. The temperature in the room may rise, so that before the surface temperature of the clothes is sensed, it had better blow air to the entire clothes for a given time, e.g. one minute, after the heating is halted. The difference in surface temperature is desirably set at a greater value, e.g. 0.5 K, than that set in step S04. This difference is used as a criterion for the determination on an end of the drying operation.

In step S12, when some pieces of the clothes are found not dried yet, supplemental drying operation (S13) is done. In step S13, the air is blown to a divisional area where the some pieces of clothes net dried yet exist while the heating and drying operation is continued for a given time, e.g. 5 minutes, and then the determination (S11) on an end of drying operation is done again. When positive determination is done, microprocessor 17 stores that actual dry-end time.

As discussed above, the determination (S12) on an end of the drying operation after the heating is temporarily halted allows reducing influence of the heating and increasing accuracy in determination. On top of that, when the clothes are not dried yet, supplemental drying operation (S13) can positively eliminate not-dried parts.

Next, feedback (S14) is demonstrated hereinafter. Microprocessor 17 compares the target dry-end time input by a user with the actual dry-end time. When both of the times are approx. equal to each other, it indicates that the determination whether or not the heating is needed goes well; however, when both the times are not so close to each other, it indicates that the determination goes wrong. The predicting curves thus need modification. This wrong determination is caused by, e.g. an area of the room or a structure of the room. To be more specific, when the room has a greater area than a supposed one or the structure of the room allows heat to escape with ease, a drying speed becomes slow when the heating starts. To the contrary, in the case of a small room or a well-insulated room, the drying speed becomes fast.

In a case, where a difference between the target dry-end time and the actual dry-end time exceeds a given time, e.g. 10 minutes, microprocessor 17 implements a feedback for modifying the predicting curves. For instance, in a case where the actual dry-end time arrives later than the target dry-end time by a time longer than the given time, the predicting curves should be modified so that the dry-end time can arrive later by several minutes. In a case where the actual dry-end time arrives earlier than the target dry-end time by a time shorter than the given time, the predicting curves should be modified so that the dry-end time can arrive earlier by several minutes.

The foregoing feedback allows the predicted dry-end time to be closer to the target dry-end time, so that the clothes dryer can improve its prediction accuracy in response to the environment where the dryer is installed.

Next, the end (S15) of ventilation and measuring the electric energy is described hereinafter. In step S15, after the determination on the end of drying operation, the ventilation is still kept for a given time, e.g. 10 minutes, before it is halted. The reason why the ventilation is still kept is this: If moisture remains in the room after the end of drying operation, the dried clothes would become humid again. The ventilation prevents the dried clothes from becoming humid.

When the ventilation is halted, microprocessor 17 prompts watt-hour meter 27 to stop measuring the electric energy, while it stores integral power consumption during the operation. Microprocessor 17 converts the electric energy into a discharge amount of $CO_2$ and a running cost, and stores those values. Coefficients to be used in the conversion are stored in microprocessor 17 in advance, e.g. 0.41 kg/kWh for the discharge amount of $CO_2$ and 22 yen/kWh for the running cost, however, users can set the coefficients for themselves.

The stored amounts of power consumption, $CO_2$ discharge, and the running cost can be displayed on information display panel 25 by depressing display-change switch 26. Depress of switch 26 during the display of those data allows changing data among those three data. The display can be changed anytime while the clothes dryer is turned on, and the displayed data is the one obtained when the clothes have been dried last time.

Display of the power consumption, $CO_2$ discharge amount, and the running cost allows the user to understand how much energy was used for drying the clothes, thereby raising user's awareness of energy saving.

Finally, microprocessor 17 turns off the clothes dryer for ending the operation (S16).

Embodiment 2

A clothes dryer in accordance with the second embodiment of the present invention has the same structure as the clothes dryer in accordance with the first embodiment, so that the same reference signs for the structural elements are used here, and the descriptions thereof are omitted here. The steps of controlling the clothes dryer in accordance with the second embodiment use the same step numbers as those of the first embodiment except the step of sensing the surface temperature of the clothes (S03), and the descriptions of the same steps are omitted here.

Figure 13:
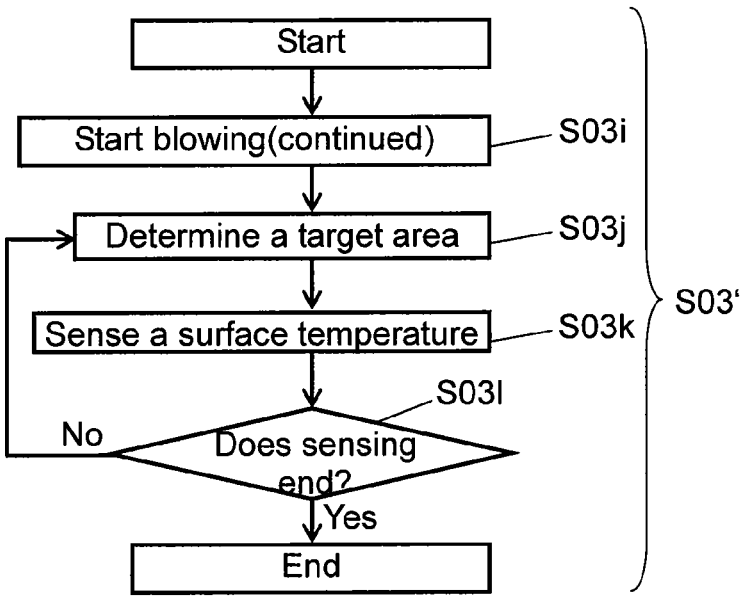
FIG. 13 shows a flowchart of controlling over sensing of a surface temperature (S03') in a clothes dryer in accordance with a second embodiment of the present invention.

A step of sensing a surface temperature of the clothes in the clothes dryer (S03') is demonstrated hereinafter with reference to FIG. 13, which shows a flowchart of controlling the sensing of surface temperature by the clothes dryer in accordance with the second embodiment.

When step S03' starts, controller 16 starts blowing air to the clothes (S03*i*) in the same manner as that of the blowing and drying operation (S08). In a case where the operation takes step S03' at the first time since the beginning of the operation of the clothes dryer, the air is blown to the entire sensing area in a pivoting manner. In a case where the operation takes step S03' second time or more, the blowing area has been fixed (S05) and the blowing and drying operation (S08) has been done already, so that the blowing of the blowing and drying operation (S08) is kept going. In either case, controller 16 prompts motor 6 to pivot louvers 5 at given intervals, e.g. 0.1 sec/degree.

Next, microprocessor 17 fixes a sensing-target area (S03*j*). In a case where the operation takes step S03' second time or more, since the air has been blown only to the areas where wet clothes exist, a surface temperature of the clothes should be sensed only in the areas, determined that the wet clothes have existed at the last time of sensing the surface temperature. Other methods involved here are the same as those used when the target area is fixed (S03*a*) in the first embodiment.

Microprocessor 17 then senses surface temperatures of the clothes (S03*k*). At this time, microprocessor 17 firstly instructs controller 16 to operate motor 10 so that infrared sensor 9 can be directed toward the sensing target area. Microprocessor 17 then stores the results sensed by infrared sensor 9 at given intervals, e.g. every one second, until a given time elapses, e.g. at least while louvers 5 make a single to-and-fro motion, for instance, 30 seconds. The results sensed by infrared sensor 9 are thus sequentially stored at least while louvers 5 make a single to-and-fro motion, whereby a surface temperature when the clothes catch the air blow and another surface temperature when the clothes catch no air blow can be both obtained.

Based on this sensing result, the surface temperature sensed when the air is not blown to the clothes in the target area is referred to as the highest temperature, and another surface temperature sensed when the air is blown to the clothes therein is referred to as the lowest temperature. The difference in surface temperature between the clothes cachng the air blow and the clothes catching no air blow can be thus obtained.

The foregoing method allows obtaining the difference in surface temperature, so that motor 6 can be controlled in the same manner as both in step S03' of sensing surface temperatures and in step S08 of the blowing and drying operation. In other words, as for the blowing, motor 6 can be controlled in such a simple manner as the pivot-blowing can be kept toward the areas where the wet clothes exist. As a result, such a complicated control method as done by the clothes dryer in accordance with the first embodiment, i.e. changing a blowing direction for sensing a surface temperature of clothes, is not need in this second embodiment. This simple control method of the air-blowing direction allows reducing the cost involved both in the control board and the programming.

Finally, microprocessor 17 determines whether or not the sensing of the surface temperatures ends in all the target areas (S03*i*). If some areas are left not sensed yet, next target areas are fixed (S03*j*). When all the areas have been sensed, then step S03' ends.

As discussed above, the second embodiment of the present invention determines the degree of dryness in the clothes based on the difference in surface temperature between the clothes catching air blow and the same clothes catching no air blow, and then determines when the heating should start based on the degree of dryness.

When the clothes are wet, blowing air thereto deprives the clothes of heat due to evaporation, thereby lowering the temperature thereof. The foregoing method for controlling the degree of dryness in the clothes thus measures the surface temperatures of both the clothes, i.e. when the clothes catch the air blow and when the clothes catch no air blow. When the difference in surface temperature is great, it is determined that the clothes contain a greater amount of moisture, and when the difference is small, it is determined that the clothes contain a smaller amount of moisture. The degree of dryness in wet clothes can be thus accurately determined, so that a dry-end time of the wet clothes can be predicted accurately. This second embodiment thus can provide the control method, featuring this accurate prediction, for drying clothes.

The second embodiment also provides the following control method for drying clothes: the method determines a heat starting time by comparing a dry-end time predicted assuming that the heating is started based on the degree of dryness in clothes with a target dry-end time fixed in advance. In a case where the clothes cannot be dried by the target dry-end time without the heating, the method can determine when the heating should be started for drying the clothes within a minimal heating time before the target dry-end time elapses. The method thus allows the clothes dryer to dry the clothes within a time desired by a user in an energy-saving manner.

The clothes dryer in accordance with the second embodiment comprises the following elements:

- a blower for blowing air to clothes, a surface temperature sensor for sensing a surface temperature of the clothes, a heater for heating the clothes, an absolute humidity sensor for sensing an absolute humidity around the clothes, a controller for controlling the blower and the heater, a drying predictor for predicting a time necessary for drying the clothes based on the information sent from the surface temperature sensor and the absolute humidity sensor, a time input device for a user to input a target dry-end time by which the clothes are desirably dried, a heat indication device for indicating a timing when the heater should be used, and a timer for measuring time.

Using the blower, the controller forms a state where the clothes catch the air blow and another state where the same clothes do not catch the air blow. The drying predictor calculates a degree of dryness in the clothes based on the following information by using a difference in surface temperature between the two states discussed above:

- availability of the air blown to the clothes;
- the clothes' surface temperatures sensed by the surface temperature sensor; and
- the absolute around-the-clothes humidity sensed by the absolute humidity sensor.

The drying predictor then predicts a dry-end time based on the degree of dryness assuming that the drying of the clothes starts from the calculation of the degree of dryness. The heat indication device compares the dry-end time with the target dry-end time, and when the dry-end time is the same as or later than the target dry-end time, the heat indication device prompts the controller to use the heater.

When wet clothes catch the air blow, the temperature of the clothes lowers due to heat of evaporation. The clothes dryer discussed above thus accurately determines the degrees of dry in the clothes at intervals, thereby fixing the heat starting time so that the heating time can be shortened. As a result, the clothes dryer of the present invention can finish drying the clothes in an energy saving manner within a time desired by a user.

The clothes dryer in accordance with the second embodiment of the present invention includes a temperature sensing device for sensing an air temperature around clothes, and the drying predictor can change a dry-end time, predicted upon a start of heating, with a temperature sensed by the temperature sensing device. The clothes dryer thus can dry the clothes in an energy saving manner within a time desired by a user in response to the air temperature around the clothes.

In a case where the heat indication device instructs the clothes dryer to use the heater, the dryer in accordance with the second embodiment of the present invention keeps heating until the target dry-end time is over, and then halts heating, so that the heating is done nonstop within a batch of time for reducing the energy loss.

After the heater is halted, the drying predictor of the clothes dryer in accordance with the second embodiment determines whether or not the drying operation for the clothes ends based on a difference in surface temperature, sensed by the surface temperature sensor, between the clothes catching air blow and the clothes catching no air blow. When the determination tells that the drying operation does not end yet, then the controller of the clothes dryer heats the clothes again using both of the heater and the blower for a given period. When the determination tells that the drying operation has ended, then the clothes dryer ends its operation. A smaller difference in surface temperature between the clothes catching air blow and the clothes catching no air blow allows the clothes dryer to determine that the drying operation ends. However, when the clothes are heated, an error sometimes can happen in the difference in surface temperature, so that if the clothes are not dried yet, the determination that the drying operation has ended after the heating operation allows the clothes can be heated again. As a result, not-dried sections in the clothes can be eliminated.

The clothes dryer in accordance with the second embodiment includes a memory device which stores the target dry-end time input by a user, an actual drying time measured by the timer. When the clothes do not dry by the target dry-end time, the memory device feeds back this information to the clothes dryer such that the drying predictor should predict the dry-end time to arrive later than the last one. On the contrary, when the clothes have been dried earlier than the target dry-end time, the memory device feeds back this information to the clothes dryer such that the drying predictor should predict the dry-end time to arrive earlier than the last one. A prediction of the dry-end time sometimes incurs an error between the predicted dry-end time and the actual dry-end time depending on the environment where the clothes dryer is installed. In a case where the drying operation does not end within a predicted target dry-end time, feedbacks are repeated for the predicted time to become closer to the actual dry-end time. The clothes dryer thus can improve prediction accuracy in response to the environment where the clothes dryer is installed.

The clothes dryer in accordance with the second embodiment allows the controller to prompt both of the heater and the blower to heat the clothes for a given time in the case where the clothes have been dried without using the heater. When the clothes have been dried without using the heater, the degree of dryness in the clothes is equilibrium with the degree of dryness of the air around the clothes; however, if the clothes are heated after they have been dried, the clothes can be kept in a further dried state than the foregoing equilibrium state.

The clothes dryer in accordance with the second embodiment includes a relative humidity sensor for sensing a relative humidity around the clothes. The controller allows heating the clothes after the drying operation has ended only when the relative humidity sensed by the relative humidity sensor is higher than a given value. When the drying operation ends in a highly humid state without heating the clothes, the clothes still contain moisture, so that heat is applied to the clothes after the drying operation in order to keep the clothes in a further dried state than the equilibrium state discussed in the previous paragraph.

The clothes dryer in accordance with the second embodiment includes a sensing direction changer for changing a sensing direction of the surface temperature sensor, a louver device for changing a direction of the air blown from the blower, and a direction sensor for sensing a direction toward wet clothes existing around the clothes dryer. The controller can control these three structural elements discussed above. The controller zones the clothes into multiple areas in advance, and prompts the sensing direction changer to sense a degree of dryness in the clothes in each area, and prompts the direction sensor to sense a direction toward the wet clothes, and prompts the louver device to blow the air along the direction toward the wet clothes. Since degrees of dry in the clothes can be obtained from the greater areas, the dry-end time of the clothes can be predicted more accurately. Since the air is blown to the wet clothes, the clothes can be prevented from being dried unevenly. As a result, the shorter dry-time can be expected.

When the surface temperature sensor senses a surface temperature of the clothes catching no air blow, the controller prompts the louver device to blow the air to the clothes which are then not the target of the surface temperature sensor. The clothes dryer thus can always keep blowing the air to the clothes while a degree of dryness in the clothes is sensed, so that the drying time can be shortened.

The clothes dryer in accordance with the second embodiment can predict a dry-end time this way: The controller instructs the louver device to blow the air intermittently to the clothes, and the surface temperature sensor senses the surface temperatures sequentially to find the highest temperature and the lowest one of the same clothes. The drying predictor predicts the dry end time based on the difference between the highest and the lowest temperatures as a difference in surface temperature between the clothes catching the air blow and the same clothes catching no air blow. When the clothes dryer senses a degree of dryness in the clothes, no special control over the air-blowing direction is needed except that the louvers make to-and-fro motion, so that the dryer needs a simple method for controlling the air-blowing direction.

Embodiment 3

Figure 14:
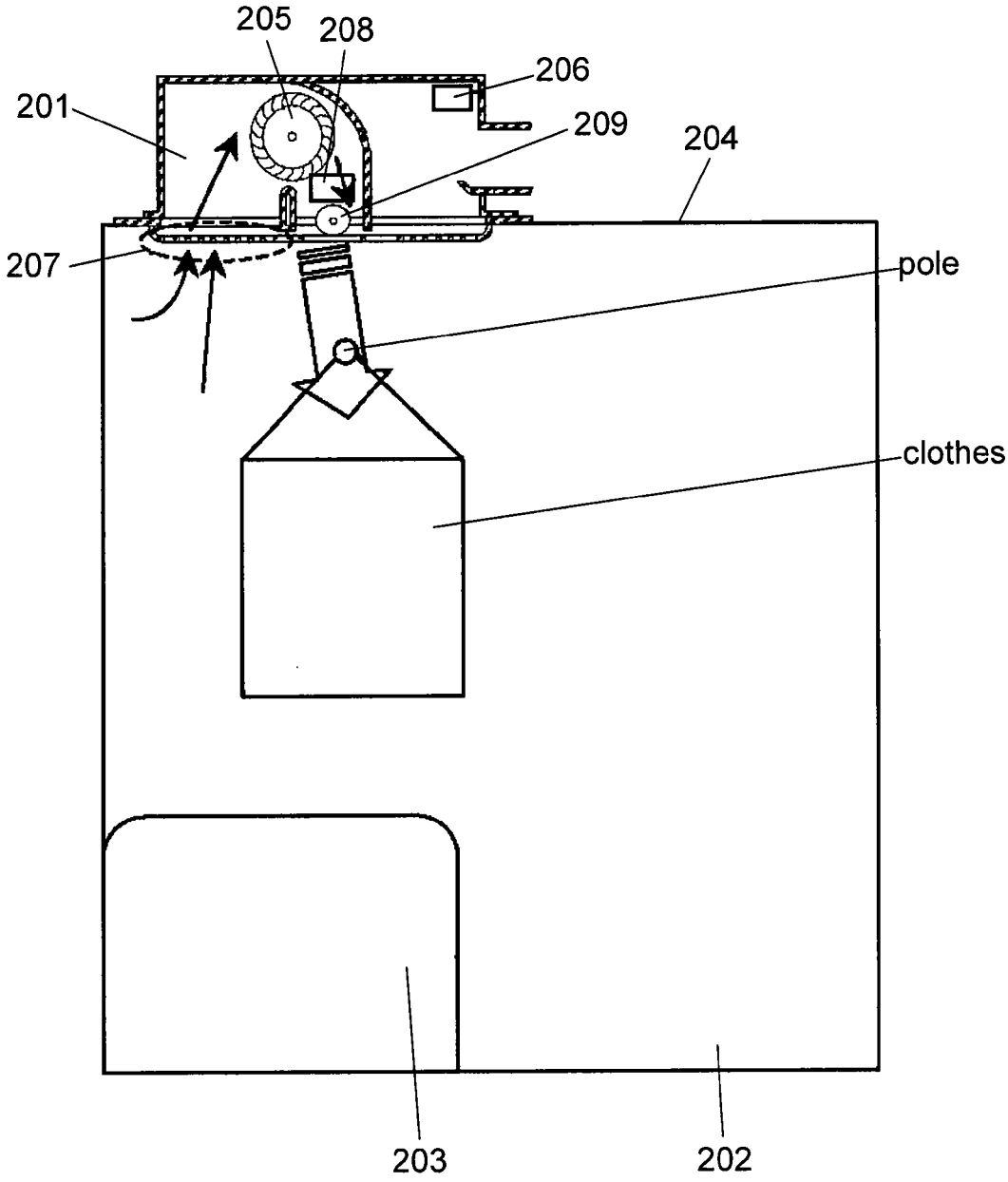
FIG. 14 shows a sectional view of a main unit of a clothes-dryer in accordance with a third embodiment of the present invention.
Figure 15:
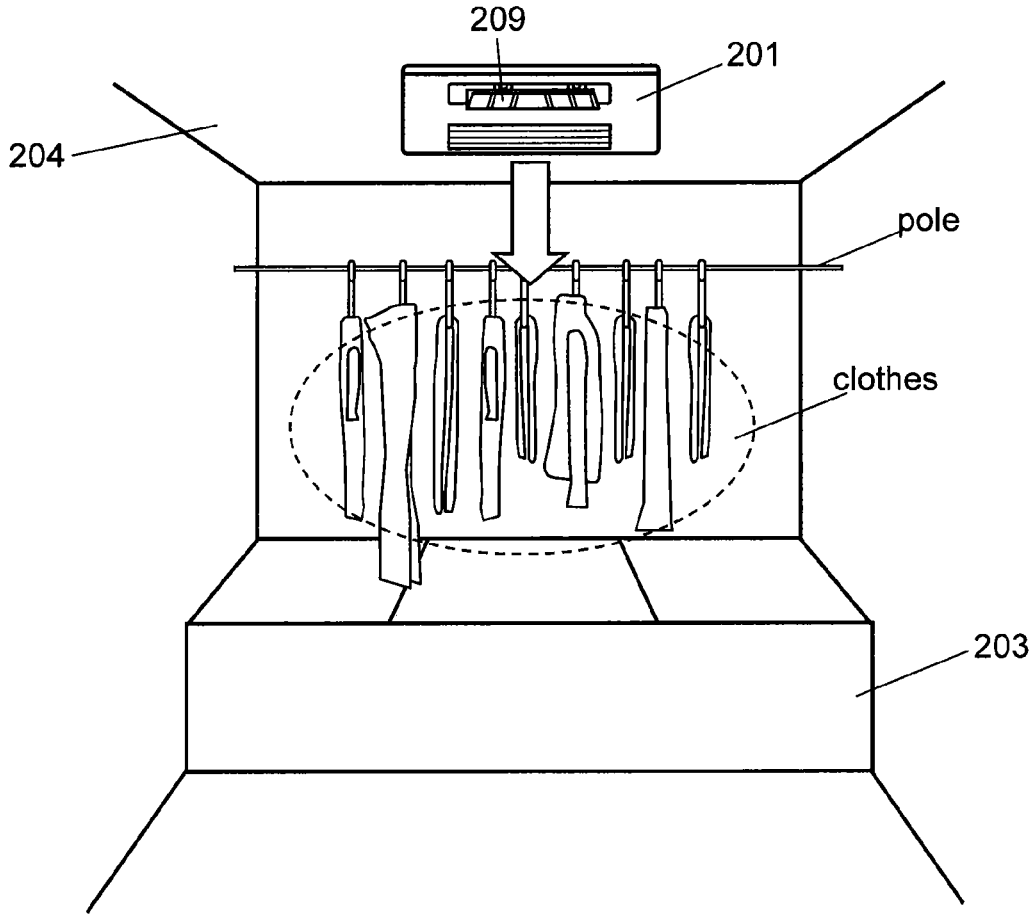
FIG. 15 shows an external appearance of a main unit of the clothes dryer.

A clothes-dryer in accordance with the third embodiment is a clothes-dryer installed in a bath. FIG. 14 shows a sectional view of a main unit of the clothes dryer in accordance with this third embodiment. FIG. 15 shows an external appearance of the main unit of the clothes dryer shown in FIG. 14.

As shown in FIGS. 14 and 15, main unit 201 is installed behind ceiling 204 above bath tub 203 in bath 202, and the wet washing is hung under main unit 201, which blows air to the washing for drying the washing (clothes).

Main unit 201 includes blower 205, controller 206, sucking port 207 located upstream from blower 205 for sucking air from the room, and blow-off port 208 located downstream from blower 205. Sucking port 207 communicates with blow-off port 208 via an air duct. Main unit 201 also includes louver device 209 near blow-off port 208. Main unit 201 can be formed of at least blower 205 and louver device 209 and at least can aim at drying clothes, so that it is not always a bath-type clothes dryer but it can be a humidifier and the like.

Figure 16:
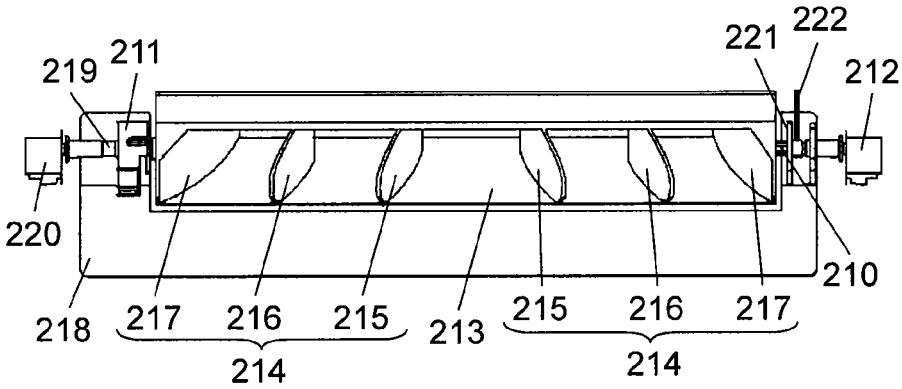
FIG. 16 shows an external appearance of a louver device of the clothes dryer.

FIG. 16 shows an external appearance of the louver device of the clothes dryer in accordance with the third embodiment. As shown in FIG. 16, louver device 209 comprises rotary shaft 210, holder 211, driver 212, flap 213, and louvers 214.

Rotary shaft 210 rotatably supports louver device 209, and holder 211 is placed at a first end of rotary shaft 210 for rotatably holding rotary shaft 210. Driver 212 is placed at a second end of shaft 210 for rotating rotary shaft 210, and flap 213 is rigidly mounted to rotary shaft 210 and regulates a direction of air-flow, supplied from blow-off port 208, along the rotating direction of shaft 210. Louvers 214 are placed such that they are sandwiched by and fixed to flap 213 in flaring shapes. Two louvers located at the center among louvers 214 are referred to as center louvers 215, and two louvers adjacent to center louvers 215 are referred to as midway louvers 216, and two louvers located at the side-ends are referred to as end louvers 217. Rotary shaft 210, flap 213 and louvers 214 are unitarily molded.

Figure 17A:
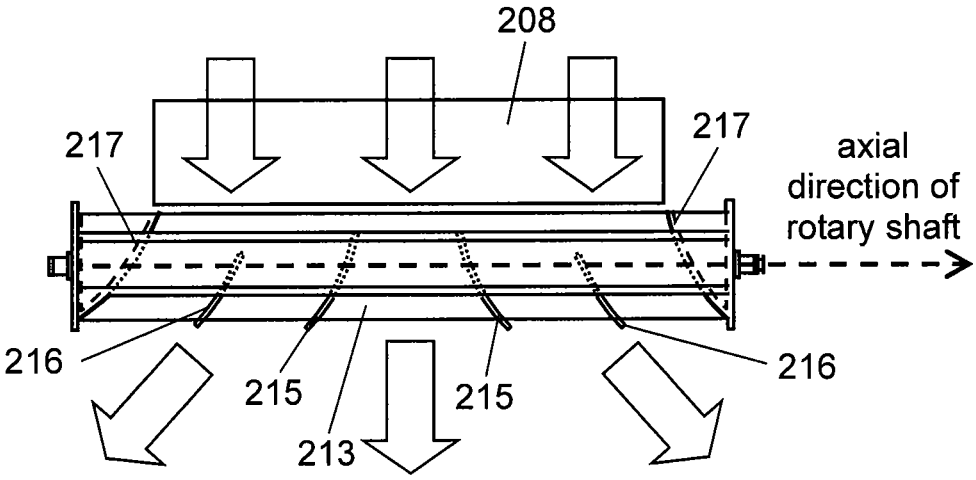
FIG. 17A shows an external appearance of the louver device when the device diffuses the airflow sent from a blower of the clothes dryer.
Figure 17B:
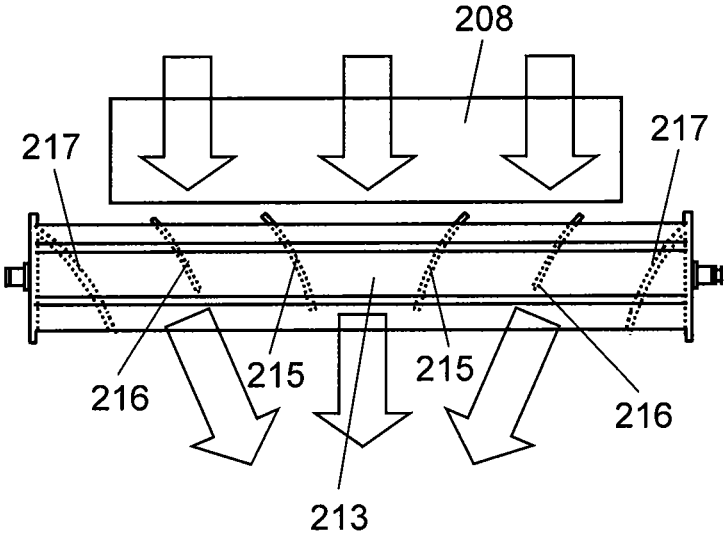
FIG. 17B shows an external appearance of the louver device when the device concentrates the airflow sent from the clothes dryer.
Figure 18:
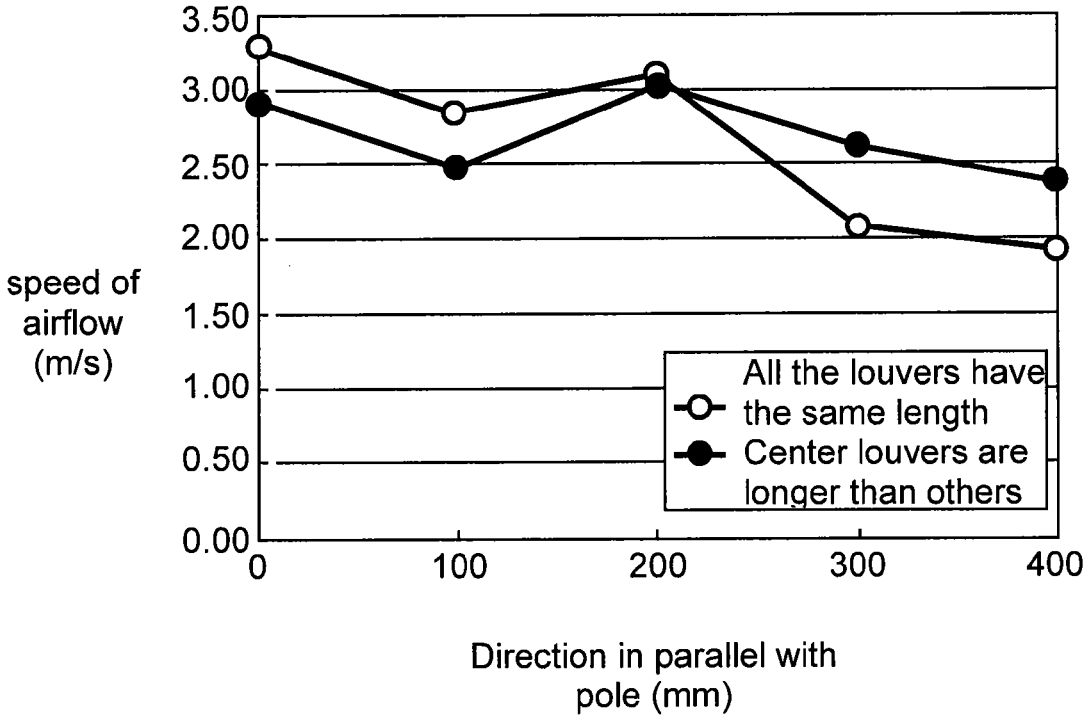
FIG. 18 shows an air-speed distribution when the louvers of the clothes dryer have the same length or the center louver is longer than the others.

FIG. 17A shows an external appearance of the louver device which diffuses the airflow sent from the blower of the clothes dryer in accordance with the third embodiment. FIG. 17B shows an external appearance of the louver device which concentrates the airflow blown from the blower. FIG. 18 shows a wind speed distribution in a case where the louvers of the clothes dryer are the same in length or the center louvers are longer than the others.

As shown in FIG. 17A, center louvers 215 are longer than midway louvers 216. FIG. 18 shows the distribution of air-speed in the area 200 mm under the pole on which the clothes are hung, and the area is divided at 100 mm pitches in parallel up to 400 mm from the pole center. A comparison between the case where midway louvers 216 are the same in length as center louvers 215 and another case where center louvers 215 are longer than midway louvers 216 tells that longer center louvers 215 improve the distribution of airflow at the ends of the pole.

Drying speed "q" of clothes is generally expressed by equation (6):

$$q=\alpha\times[(T-T')/\gamma]\times A \quad (6)$$

where,

α: heat transfer rate

T: dry-bulb temperature in the bath

T': wet-bulb temperature in the bath

γ: latent heat of vaporization

A: falling rate coefficient

In equation (6), since heat transfer rate "α" is proportional to an air speed, the drying speed depends on the wind speed, so that it is important to supply air uniformly to the clothes in order to shorten the drying time or to prevent the clothes from being dried unevenly.

The wind speed distribution shown in FIG. 18 allows expecting a shorter drying time by using longer center louvers 215. Actually a piece of cloth of 2 kg undergoes a drying test according to BL (Better Life Association) standard to find the following result: In the case where midway louvers 216 having the same length as center louvers 215 are used, the cloth needs 165 minutes to dry, while in the case where longer center louvers 215 than midway louvers 216 are used, the cloth needs 135 minutes to dry. The longer center louvers 215 thus can shorten the drying time by as much as 30 minutes.

The clothes dryer in accordance with the third embodiment includes center louvers 215 longer than midway louvers 216, and thus can increase fraction between center louvers 215 and the airflow around the center of flap 213 so that a pressure loss around the center of flap 213 can be increased to some extent. This structure allows increasing an air volume guided to the side ends of flap 213, and as a result, the airflow sent from blower 205 can be diffused uniformly, thereby shortening the drying time of the clothes.

As shown in FIG. 17A, each one of louvers 214 has a curvature preferably of approx. 200ϕ. Curved louvers 214 lower the friction between the airflow and louvers 214, so that the pressure loss within entire flap 213 can be reduced. As a result, the air volume to be guided within flap 213 can be increased, which shortens the drying time of the clothes.

As shown in FIG. 17A, a given distance is provided between an edge of flap 213 and the edges of center louvers 215 as well as the edges of midway louvers 216. This structure, i.e. louvers 215 and 216 are formed such that they start rising from midway points of flap 213, allows decreasing a pressure loss of the airflow sent from blower 205 while the airflow can be guided to flap 213. As a result, louver device 209 can control a greater amount of air volume, thereby shortening the drying time.

As shown in FIG. 17A, flap 213 is so designed as the edge thereof agrees with the edges of end louvers 217. The sections surrounded by flap 213 and the faces, drawn in broken lines and having no contact with the airflow, of end louvers 217 are sealed. This structure allows sealing the sections which do not work as air-duct for the airflow, thereby preventing the airflow running through flap 213 from dispersing. As a result, the pressure loss can be reduced, and a loss in the air volume of the airflow running through flap 213 can be minimized, thereby shortening the drying time of the clothes.

As shown in FIG. 16, assistant flap 218 is provided around flap 213. Assistant flap 218 includes assistant-flap rotary shaft 219 and assistant-flap driver 220 at its first end for driving assistant flap 218 along a rotating direction of shaft 219. It also includes assistant-flap holder 221 at its second end for holding flap 218 such that flap 218 can rotate on rotary shaft 210. Assistant flap 218 includes pivot stopper 222 on rotary shaft 210 for stopping rotary shaft 210 at a given angle set in advance.

Next, the operation of the clothes dryer in accordance with the third embodiment is demonstrated hereinafter. As shown in FIG. 16, flap 213 and assistant flap 218 are rotated respectively on rotary shaft 210 by driver 212 and assistant-flap driver 220 respectively, and they rotate at the same rotary angle.

The presence of assistant flap 218 allows improving the controllability over the airflow, due to Coandã effect, of the clothes dryer in accordance with the third embodiment, so that the speed of an airflow to the clothes can be faster, which shortens the drying time of the clothes.

As shown in FIG. 16, when driver 212 is rotated along one direction, pivot stopper 222 provided on rotary shaft 210 touches main unit 201 at a certain position, so that rotary shaft 210 stops rotating. Controller 206 controls the movement of driver 212 based on this stop position as a reference position, whereby controller 206 can recognize a control angle of louver device 209.

The recognition of the control angle of louver device 209 by controller 206 thus allows louver device 209 to be set at an optimum angle, thereby shortening the drying time.

As shown in FIG. 17A, in a case where the clothes to be dried are hung widely, the angle of rotary shaft 210 is set such that louvers 214 in flaring shapes lie along an airflow direction. The airflow is thus diffused relative to the axial direction, shown in a dotted line with an arrow mark in FIG. 17A, of rotary shaft 210.

On the other hand, as shown in FIG. 17B, in a case where only a piece of the clothes, such as jeans, should be dried in a short time, louver device 209 in flaring shapes rotates 180 degrees on rotary shaft 210, so that louvers 214 form tapering shapes relative to the airflow direction. As a result, the airflow concentrates.

As discussed above, an optimum target area can be selected depending on a volume of clothes, so that the airflow cannot be wasted, and the drying time can be shortened. As a result, energy can be saved.

Figure 19A:
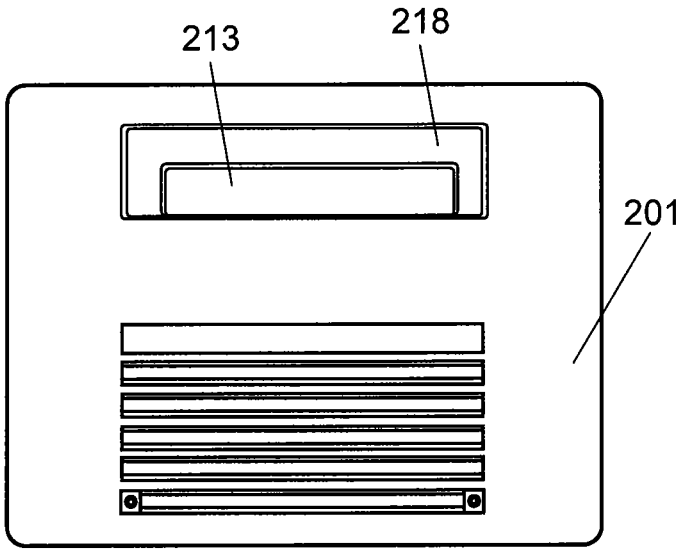
FIG. 19A shows an external appearance of the main unit of the clothes dryer when the blower stops blowing air.
Figure 19B:
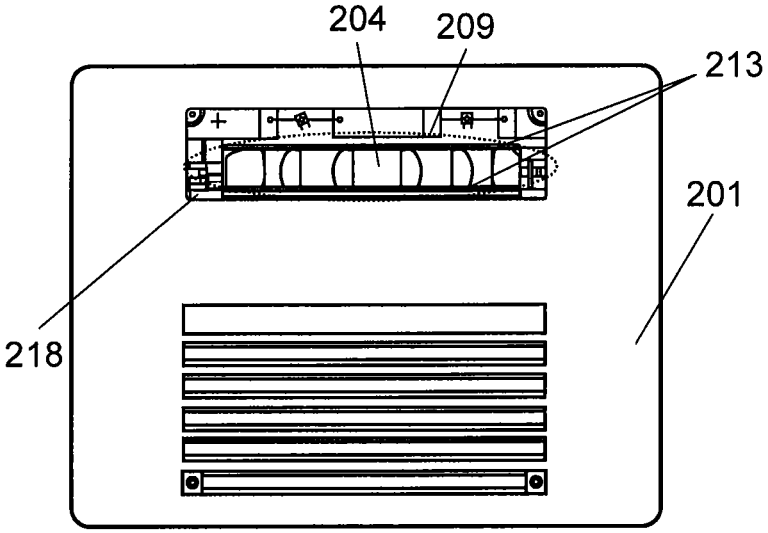
FIG. 19B shows an external appearance of the main unit of the clothes dryer when the blower blows air.

FIG. 19A shows an external appearance of the main unit of the clothes dryer in accordance with the third embodiment when the blower is halted. FIG. 19B shows an external appearance of the main unit of the clothes dryer in accordance with the third embodiment when the blower is in operation. As shown in FIG. 19B, when the air is blown, the opening of louver device 209 comes in front of main unit 201 and in parallel with flap 213, and assistant flap 218 is open. As shown in FIG. 19A, when the air-blow is stopped, flap 213 and assistant flap 218 come in front of main unit 201, so that blow-off port 208 of main unit 201 can be blocked.

The clothes dryer in accordance with the third embodiment allows flap 213 and assistant flap 218 to close blow-off port 208, whereby the external appearance of main unit 201 can be improved, and also dust can be prevented from entering main unit 201.

Embodiment 4

Figure 20A:
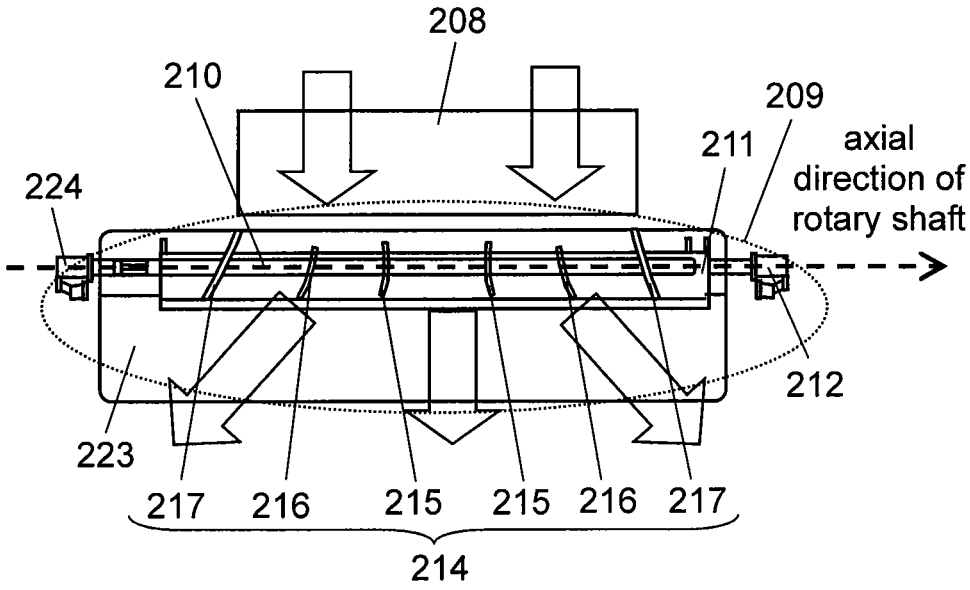
FIG. 20A shows an external appearance of a louver device, when the device diffuses the airflow, of a clothes-dryer in accordance with a fourth embodiment of the present invention.
Figure 20B:
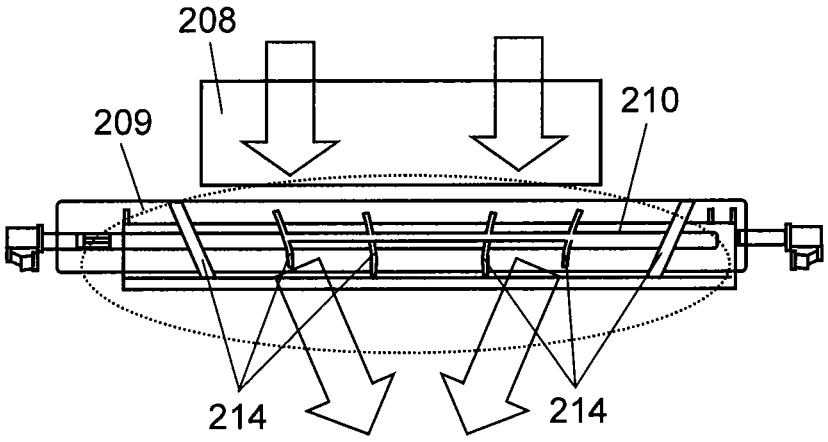
FIG. 20B shows an external appearance of the louver device when the device concentrates the airflow, of the clothe dryer.

FIG. 20A shows an external appearance of a louver device, when the device diffuses the airflow, of a clothes-dryer in accordance with the fourth embodiment of the present invention. FIG. 20B shows an external appearance of the louver device when the device concentrates the airflow. The clothes dryer in accordance with the fourth embodiment includes structural elements similar to those in the third embodiment, so that those elements have the same reference signs and the descriptions thereof are omitted here. In this fourth embodiment, only the different points from the third embodiment are described.

First, the structure of the clothes dryer in accordance with the fourth embodiment is described hereinafter. As shown in FIG. 20A, louver device 209 includes rotary shaft 210, guide wing 223, holder 211, rotating device 224, driver 212, and louvers 214. Rotary shaft 210 rotatably supports louver device 209. Guide wing 223 is held rotatably by rotary shaft 210 and controls a direction of the airflow, blown from blow-off port 208, along a rotating direction of rotary shaft 210. Holder 211 placed at a first end of guide wing 223 holds rotary shaft 210 rotatably, and rotating device 224 placed at a second end of shaft 210 rotates rotary shaft 210. Driver 212 disposed at a second end of wing 223 rotates guide wing 223. Rotary shaft 210 extends through multiple louvers 214 which are rigidly mounted on rotary shaft 210 and form flaring shapes.

Two louvers located at the center among louvers 214 are referred to as center louvers 215, and two louvers adjacent to center louvers 215 are referred to as midway louvers 216. Center louvers 215 are longer than midway louvers 216. Rotary shaft 210 and louvers 214 are unitarily molded.

Longer center louvers 215 than midway louvers 216 allow increasing friction between center louvers 215 and the airflow flowing around the center section of guide wing 223, so that the pressure loss around the center section of wing 223 can increase to some extent. This structure allows increasing a volume of airflow guided to the side-ends of wing 223, so that the airflow sent from blower 205 can be diffused uniformly, which results in a shorter drying time of the clothes.

End louvers 217 among louvers 214 are rigidly mounted on guide wing 223 in flaring shape and they are placed such that guide wing 223 can sandwich end louvers 217. Guide wing 223 includes edges on a flow-in side and flow-out side of the airflow, and each one of end louvers 217 include two edges on the flow-in side and flow-out side of the airflow. The edges of guide section 223 agree with the edges of end louvers 227.

The forgoing structure allows narrowing spaces where no airflow runs, so that the airflow running within guide wing 223 is prevented from dispersing, and thereby lowering the pressure loss. As a result, loss in air volume of the airflow running within guide wing 223 can be minimized, so that the drying time of the clothes can be shortened.

Next, the operation of the clothes dryer in accordance with the fourth embodiment is demonstrated hereinafter. As shown in FIG. 20A, in a case where the clothes to be dried are hung widely, the angle of rotary shaft 210 is set such that louvers 214 in flaring shapes lie along the airflow. The airflow is thus diffused relative to the axial direction, shown in a dotted line with an arrow mark in FIG. 20A, of rotary shaft 210.

On the other hand, as shown in FIG. 20B, in a case where only a piece of the clothes, such as jeans, should be dried in a short time, louver device 209 in a flaring shape rotates 180 degrees on rotary shaft 210, so that louvers 214 form tapering shapes relative to the airflow direction. As a result, the airflow concentrates.

As discussed above, an optimum target area can be selected depending on a volume of clothes, so that the airflow cannot be wasted, and the drying time can be shortened, so that energy can be saved.

Embodiment 5

Figure 21:
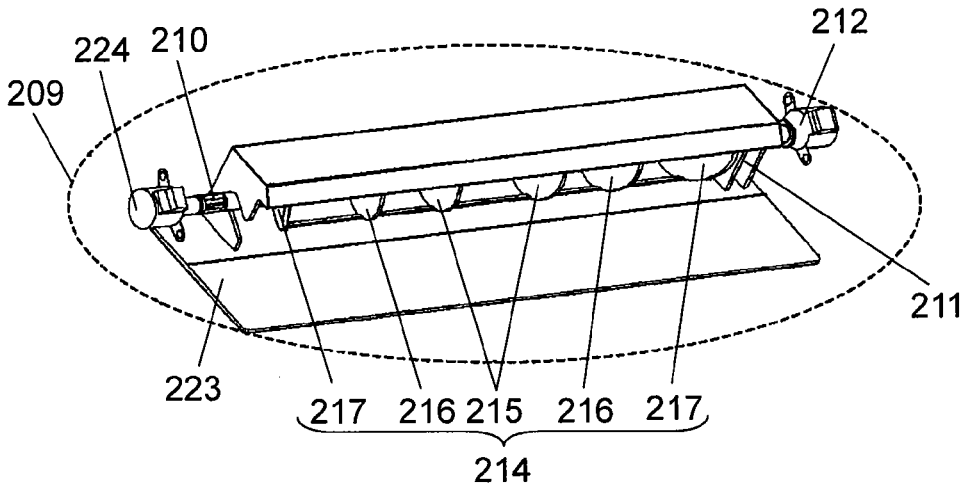
FIG. 21 shows an external appearance of a louver device of a clothes-dryer in accordance with a fifth embodiment of the present invention.
Figure 22:
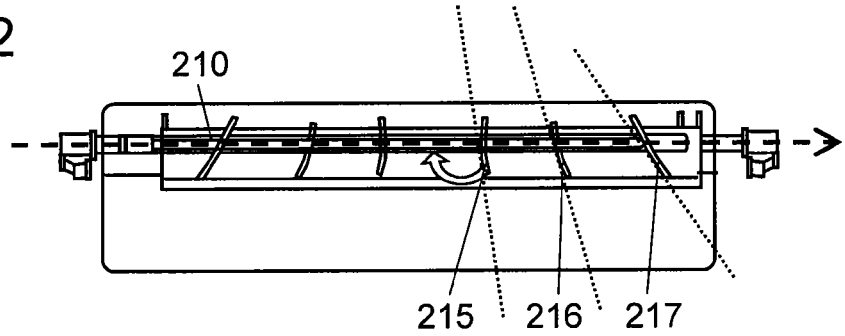
FIG. 22 shows a front view of the louver device of the clothes-dryer.

The clothes dryer in accordance with the fifth embodiment includes structural elements similar to those in the fourth embodiment, so that those elements have the same reference signs and the descriptions thereof are omitted here. In this fifth embodiment, only the different points from the fourth embodiment are described. FIG. 21 shows an external appearance of a louver device of the clothes-dryer in accordance with the fifth embodiment of the present invention. FIG. 22 shows a front view of the louver device of the clothes-dryer.

An obtuse tilt angle formed by rotary shaft 210 and louvers 214, i.e. a broken line with an arrow mark and a dotted line marked on louvers 214 form angles indicated by a bold arrow mark shown in FIG. 22. The angles increase following this order: center louvers 215, midway louvers 216, and end louvers 217.

The tilt angles of louvers 214 thus increase following the order of center louvers 215, midway louvers 216, end louvers 217, so that the airflow running through the center section of the blow-off port at a faster speed can be regulated its direction with a gentle tilt. On the other hand, the airflow running through the end sections of the blow-off port at a lower speed can be regulated its direction with a greater tilt. This structure thus allows the pressure loss within guide wing 223 to be balanced with the wind speed distribution of the airflow, so that a uniform speed of the airflow sent from blower 205 can be obtained.

Figure 23:
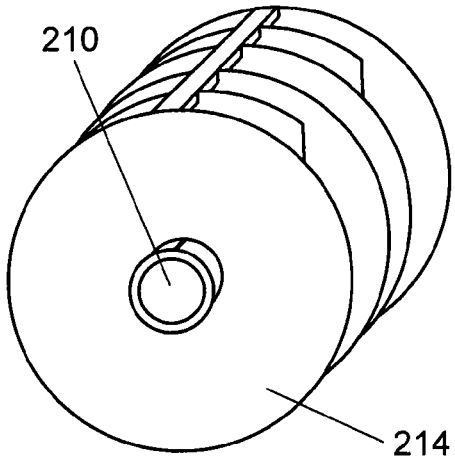
FIG. 23 shows a perspective view of the louver device of the clothes-dryer.

FIG. 23 shows a perspective view of the louvers of the clothes dryer in accordance with the fifth embodiment. A projection view of louvers 214 along rotary shaft 210 from the end of shaft 210 shows a circular form. This structure allows maximizing an air-duct area of louvers 214 while rotary shaft 210 can rotate without interference. Air leakage between guide wing 223 and louvers 214 can be prevented, so that the drying time of the clothes can be shortened.

Figure 24:
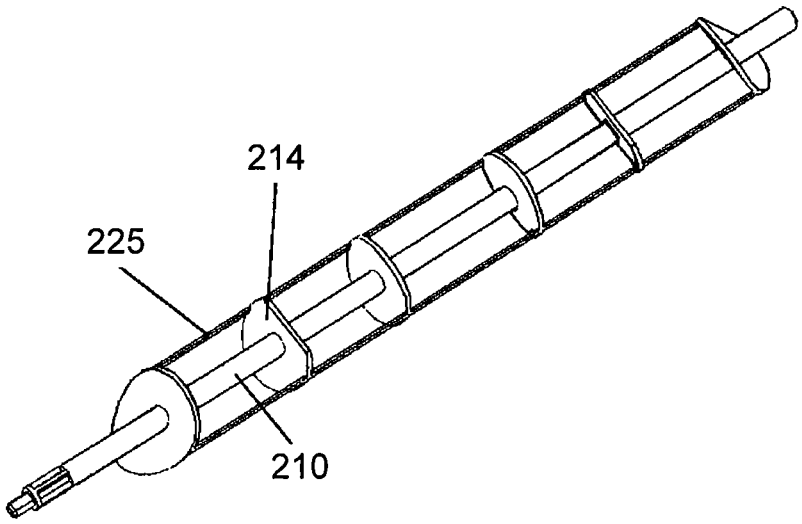
FIG. 24 shows an external appearance of louvers of the clothes dryer.

FIG. 24 shows an external appearance of the louvers of the clothes dryer in accordance with the fifth embodiment. Louvers 214 include coupling ribs 225 which couple edges of each one of louvers 214 together, and ribs 225 are thinner than a diameter of rotary shaft 210. Coupling ribs 225 are thus provided externally on louvers 214, so that louvers 214 can be stronger and their durability can increase.

Embodiment 6

Figure 25:
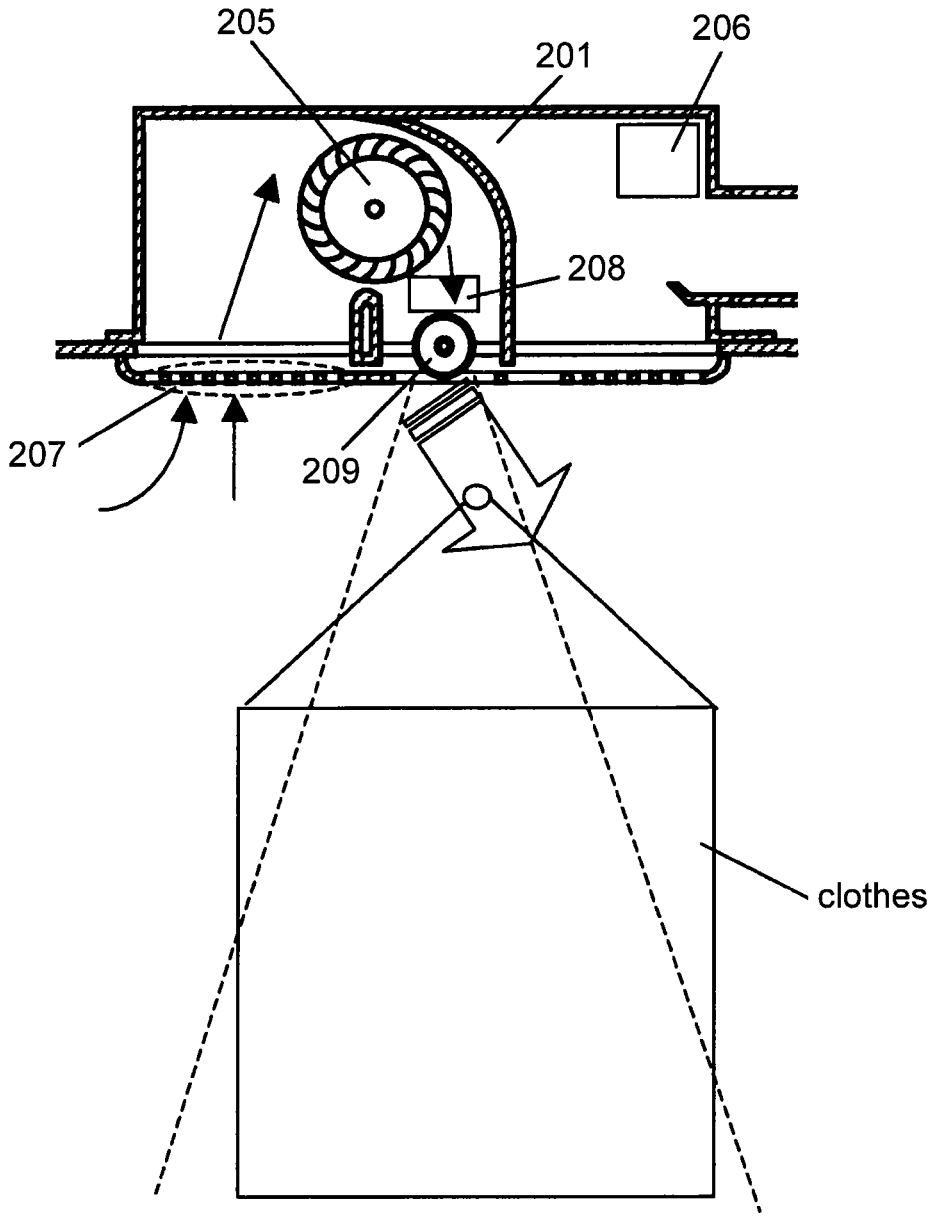
FIG. 25 shows a sectional view of a main unit of a clothes-dryer in accordance with a sixth embodiment of the present invention.

A clothes-dryer in accordance with the sixth embodiment includes structural elements similar to those in the third embodiment, so that those elements have the same reference signs and the descriptions thereof are omitted here. In this sixth embodiment, only the different points from the third embodiment are described. FIG. 25 shows a sectional view of a main unit of the clothes dryer in accordance with the sixth embodiment.

First, the structure of the clothes dryer in accordance with the sixth embodiment is described hereinafter. Main unit 201 includes blower 205, controller 206, sucking port 207 located upstream from blower 205 for sucking air from the room, and blow-off port 208 located downstream from blower 205. Sucking port 207 communicates with blow-off port 208 via an air duct in main unit 201. Main unit 201 also includes louver device 209 near blow-off port 208.

As shown in FIG. 25, when louver device 209 makes a to-and-fro motion along the rotating direction of rotary shaft 210, driver 212 should rotate in a greater angle so that the air blow can reach to hems of the clothes as shown with dotted lines in FIG. 25. At this time, controller 206 controls driver 212 such that driver 212 moves slower at a greater rotating angle.

This mechanism allows prolonging a blowing time for some clothes located off blow-off port 208, thereby preventing the clothes from being dried unevenly, shortening the drying time as well as saving energy.

Embodiment 7

Figure 26:
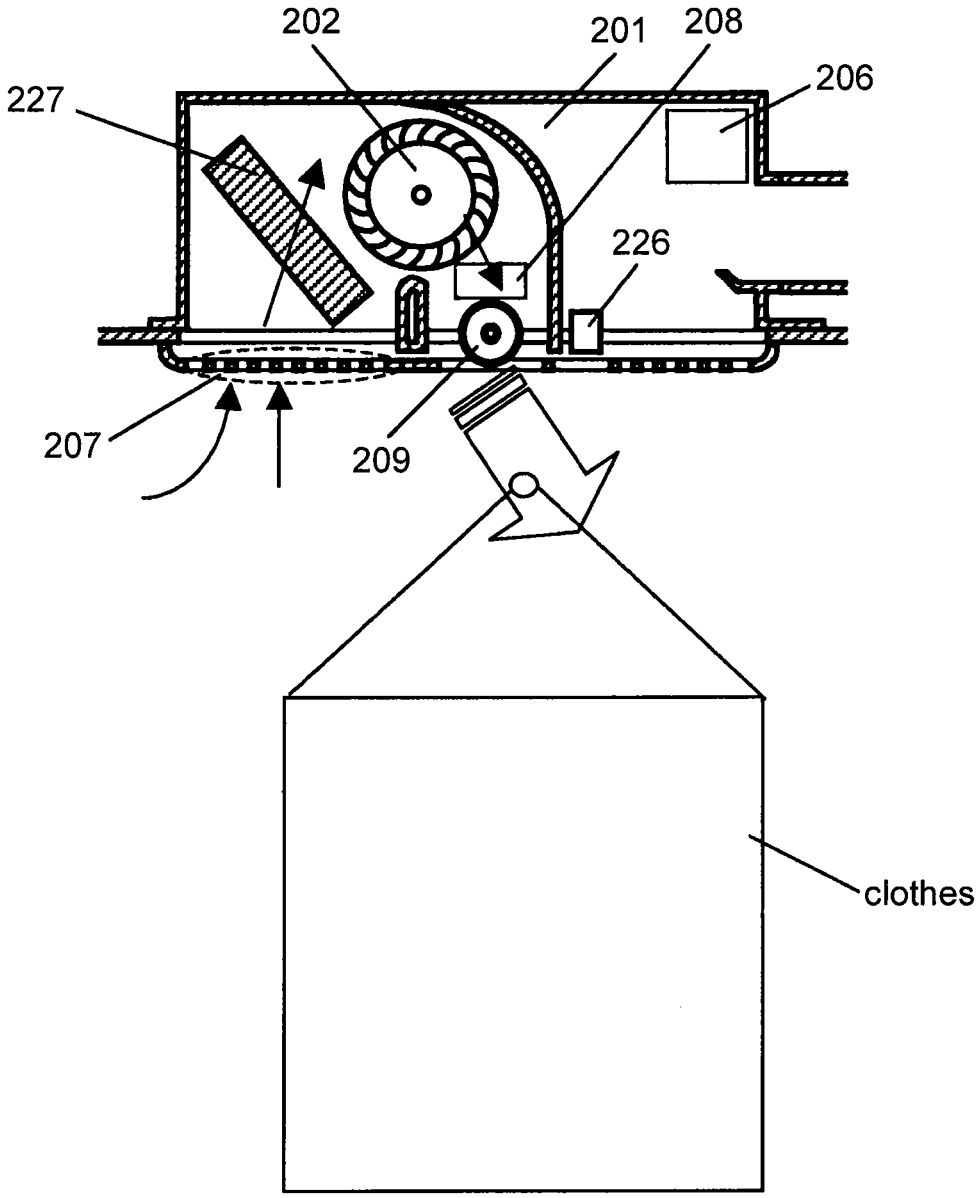
FIG. 26 shows a sectional view of a main unit of a clothes-dryer in accordance with a seventh embodiment of the present invention.

A clothes-dryer in accordance with the seventh embodiment includes structural elements similar to those in the third embodiment, so that those elements have the same reference signs and the descriptions thereof are omitted here. In this seventh embodiment, only the different points from the third embodiment are described. FIG. 26 shows a sectional view of a main unit of the clothes dryer in accordance with the seventh embodiment.

First, the structure of the clothes dryer in accordance with the seventh embodiment is described hereinafter. As shown in FIG. 26, infrared sensor 226 is placed near blow-off port 208 of main unit 201 for sensing a temperature of an object existing in an area to which blower 205 blows air. Main unit 201 includes heat source 227.

Infrared sensor 226 is not specified here; however, it can employ a thermal infrared sensor such as thermopile, pyro, thermistor, or a quantum infrared sensor such as photodiode.

Heat source 227 is not specified here; however, it can employ a general purpose heater such as carbon heater, ceramic heater, nichrome heater, halogen heater, or heat exchanger for supplying an amount of heat from the outside.

Next, operation of the clothes dryer in accordance with the seventh embodiment is demonstrated hereinafter. When air at an ambient temperature is blown to clothes including a damp section, the moisture evaporates while it deprives the damp surface of heat. The temperature of this damp section of the clothes thus lowers. Infrared sensor 226 senses a temperature lowering for identifying a damp section in the clothes, thereby controlling louver device 209 to blow air toward this damp section. After the damp section is identified, controller 206 prompts heat source 227 to operate for blowing warm air. In a case where the air-blowing to the clothes does not lower the temperature, it is determined that the clothes have been dried. In this case, blower 205 is stopped, and blow-off port 209 of main unit 201 is closed with louver device 209.

The clothes dryer in accordance with the seventh embodiment thus prevents the clothes from being dried unevenly, and shortens the drying time. On top of that, the clothes dryer allows blowing warm air, thereby further shortening the drying time. Sensing a dry-end of the clothes allows saving useless blowing, so that energy can be saved.

The clothes dryer of the present invention includes the main unit having the blower and the blow-off port, and the louver device placed in the air-duct of the blow-off port for controlling a direction of the airflow blown from the blower. The louver device comprises the following elements:

a rotary shaft for rotatably supporting the louver device;

a holder placed at a first end of the rotary shaft for rotatably supporting the rotary shaft;

a driver placed at a second end of the rotary shaft for rotating the rotary shaft;

a controller placed in the main unit for controlling the driver;

a flap rigidly mounted to the rotary shaft for regulating a direction of airflow, blown from a blow-off port, along the rotating direction of the rotary shaft; and multiple louvers placed such that the flap sandwiches the louvers, and fixed on the flap in flaring shapes.

The multiple louvers include center louvers located around the center of the blow-off port, two end louvers located at the side-ends of the blow-off port, and midway louvers located between the end louvers and the center louvers. The center louvers are longer than the midway louvers, so that a rotation or a reverse rotation of the rotary shaft by 180 degrees will diffuse or concentrate the airflow along the axial direction of the rotary shaft. Since the multiple louvers are fixed on the flap in flaring shapes, the airflow running in the air duct can be diffused wider than the width of the opening of the blow-off port. On the other hand, a reverse rotation of the multiple louvers by 180 degrees on the rotary shaft will concentrate the airflow narrower than the width of the opening.

When the airflow blown from the blower runs through the air duct in the main unit, friction against the air-duct wall lowers a speed of the airflow nearer to the wall while the airflow runs faster around the center of the air duct. The longer center louvers than the midway louvers thus increase the friction between the center louvers and the airflow running around the center of the flap, so that a pressure loss around the center of the flap can be somewhat increased, and an air volume of the airflow guided to the side-ends of the flap can be increased. As a result, the airflow blown from the blower can be diffused uniformly.

The clothes dryer of the present invention includes the main unit having the blower and the blow-off port, and the louver device placed in the air-duct of the blow-off port for controlling a direction of the airflow blown from the blower. The louver device comprises the following element:

a rotary shaft for rotatably supporting the louver device;

a guide wing held by the rotary shaft rotatably for regulating a direction of the airflow, supplied from the blow-off port, along the rotating direction of the rotary shaft;

a holder placed at a first end of the guide wing for rotatably holding the rotary shaft;

a rotating device placed at a second end of the rotary shaft for rotating the rotary shaft;

a driver placed at a second end of the guide wing for rotating the guide wind a controller placed in the main unit for controlling the driver; and multiple louvers, through which the rotary shaft extends, fixed on the rotary shaft in flaring shapes.

The multiple louvers include center louvers located around the center of the blow-off port, two end louvers located at the side-ends of the blow-off port, and midway louvers located between the end louvers and the center louvers. The center louvers are longer than the midway louvers, so that a rotation or a reverse rotation of the rotary shaft by 180 degrees will diffuse or concentrate the airflow along the axial direction of the rotary shaft. Since the multiple louvers are fixed on the rotary shaft in flaring shapes, the airflow running in the air duct can be diffused wider than the width of the opening. On the other hand, a reverse rotation of the multiple louvers by 180 degrees on the rotary shaft will concentrate the airflow narrower than the width of the opening of the blow-off port.

When the airflow blown from the blower runs through the air duct in the main unit, friction against the air-duct wall lowers a speed of the airflow nearer to the wall while the airflow runs faster around the center of the air duct. The longer center louvers than the midway louvers thus increase the friction between the center louvers and the airflow running around the center of the guide wing, so that a pressure loss around the center of the guide wing can be somewhat increased, and an air volume of the airflow guided to the side-ends of the guide wing can be increased. As a result, the airflow blown from the blower can run at a uniform speed and be diffused uniformly.

The clothes dryer of the present invention includes the louvers each of which has a curved face, which decreases friction between the airflow and the louvers, so that a pressure loss within the entire flap can be reduced. As a result, airflow having a greater air volume can be guided in the flap.

An obtuse tilt angle is formed by the rotary shaft and the louvers. The obtuse tilt angles increase following this order: center louvers, midway louvers, and end louvers.

The airflow running through the center sections of the blow-off port at a faster speed can be regulated its direction by a gentle tilt. On the other hand, the airflow running through the side-end sections of blow-off port at a lower speed can be regulated its direction by a greater tilt. This structure thus allows the pressure loss within the flap to be balanced with the wind speed distribution of the airflow, so that a uniform speed of the airflow sent from the blower can be obtained.

Embodiment 8

Figure 27:
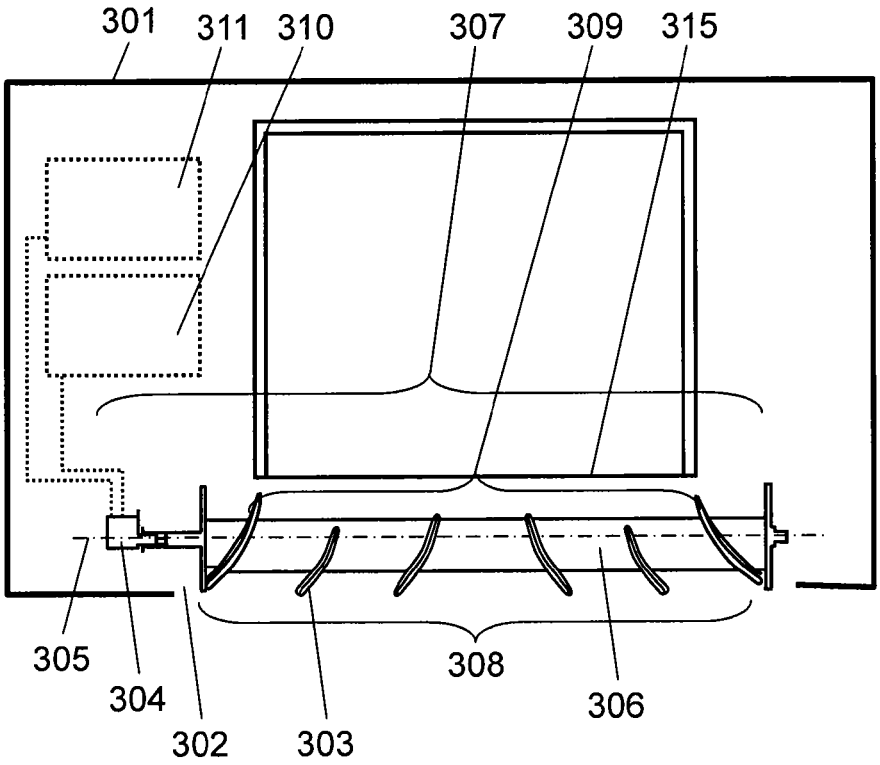
FIG. 27 shows a sectional view of a louver device of a clothes-dryer in accordance with an eighth embodiment of the present invention.
Figure 28:
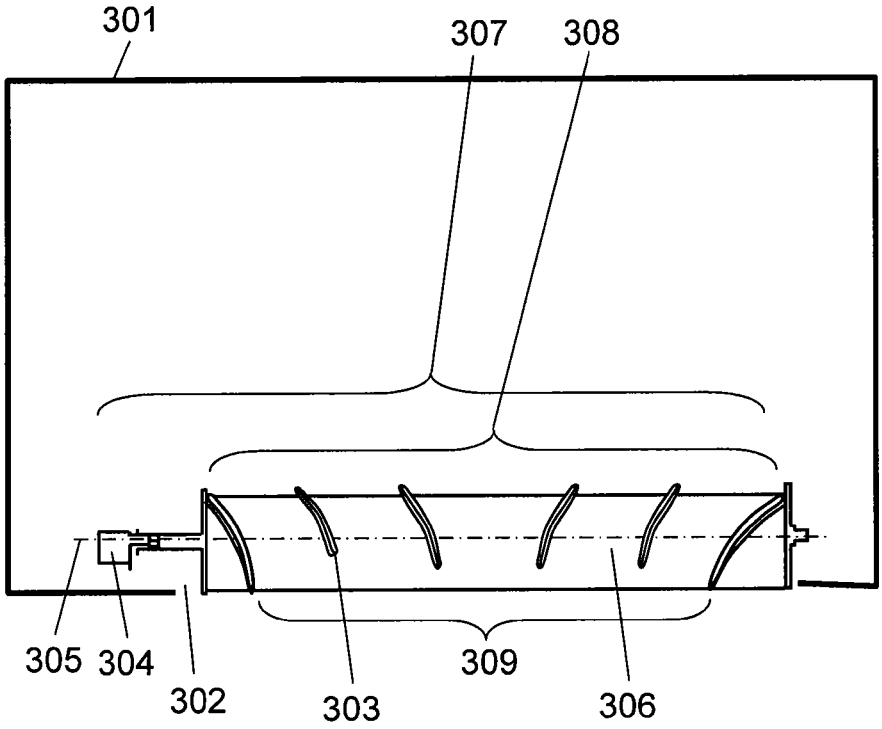
FIG. 28 shows a sectional view illustrating a state where air blown through the louver device is concentrated.
Figure 29:
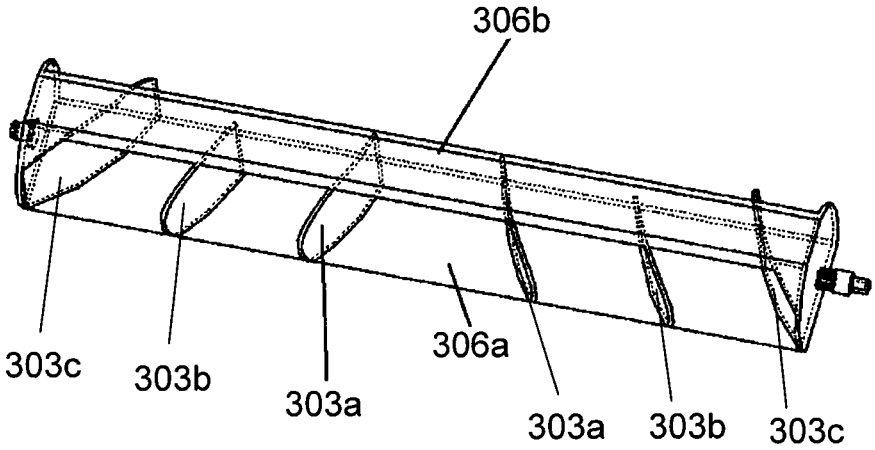
FIG. 29 shows a perspective view of the louver device of the clothes dryer.

FIG. 27 shows a sectional view of a louver device of a clothes-dryer in accordance with the eighth embodiment of the present invention. FIG. 28 shows a sectional view illustrating a state where air blowing through the louver device is concentrated. FIG. 29 shows a perspective view of the louver device of the clothes dryer.

Clothe dryer 301 includes blow-off port 302 for blowing air from dryer 301, multiple louvers 303 shaping in linear form or having a curvature. Clothe dryer 301 also includes rotary shaft 305 connected to driver 304, and flap 306 formed of two flaps 306*a* and 306*b*, which regulate a direction of airflow in a rotating direction of rotary shaft 305 and are formed unitarily with louvers 303 such that the two flaps sandwich louvers 303. Louvers 303*b* located around the side-ends of flaps 306*a*, 306*b* are tilted at greater angles relative to rotary shaft 305 than louvers 303*a* located around the center of flaps 306*a*, 306*b*. Louvers 303*c* closer to the side-ends of flaps 306*a*, 306*b* are tilted in an opposite direction to each other.

Louver device 307 has diffusion open side 308 where louvers 303 form flaring shapes, and concentration open side 309 where louvers 303 form tapering shapes.

Diffusion open side 308 has a greater area, where airflow runs, than concentration open side 309. A width of this greater area of diffusion open side 308 is approximately the same width of blow-off port 302. Concentration open side 309 has a width approx. the same as the width of air-duct 315 of the main unit. Both the side-ends, where no air runs, of concentration open side 309 are closed to prevent the air from leaking. This air-leakage will reduce a speed of the air running from louver device 307.

Louver device 307 is divided by two flaps 306*a*, 306*b* shaping in cylindrical form, where flap 306*a* is longer than flap 306*b*. This structure allows enlarging the areas of air-ducts leading to diffusion open side 308 and concentration open side 309 and also producing attachment effect, i.e. the airflow attaches to the flaps, due to longer flap 306*a*.

Louver device 307 includes to-and-fro motion time controller 310 which allows louver device 307 to rotate to-and-fro on rotary shaft 305 at variable speeds. It also includes to-and-fro motion angle controller 311 which allows louver device 307 to rotate to-and-fro at multiple angles on rotary shaft 305.

Figure 30:
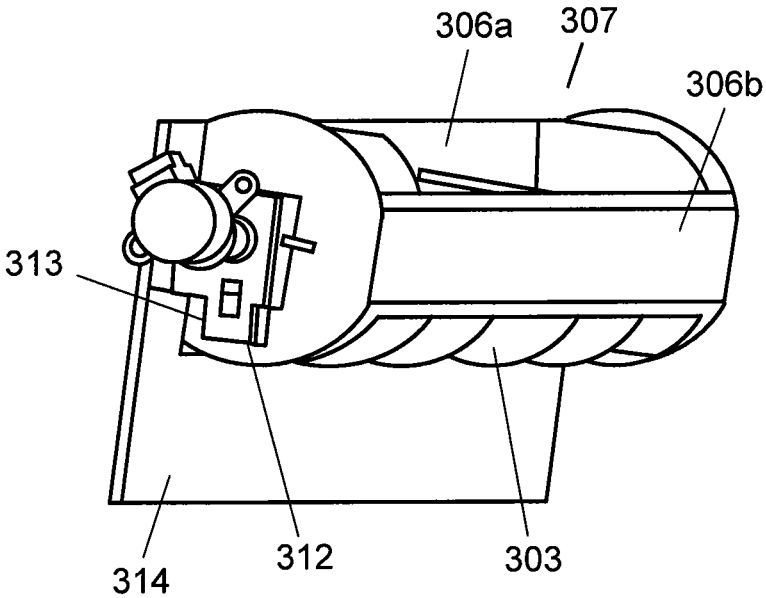
FIG. 30 shows a perspective view of a positioning device of the louver device of the clothes dryer.
Figure 31:
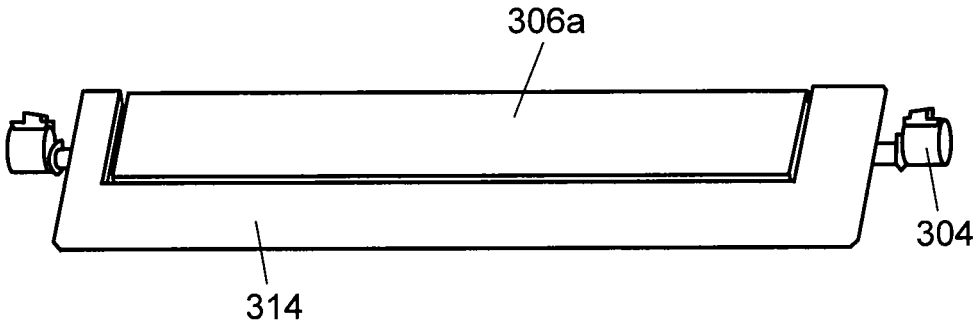
FIG. 31 shows a perspective outside view of the louver device of the clothes dryer.
Figure 32:
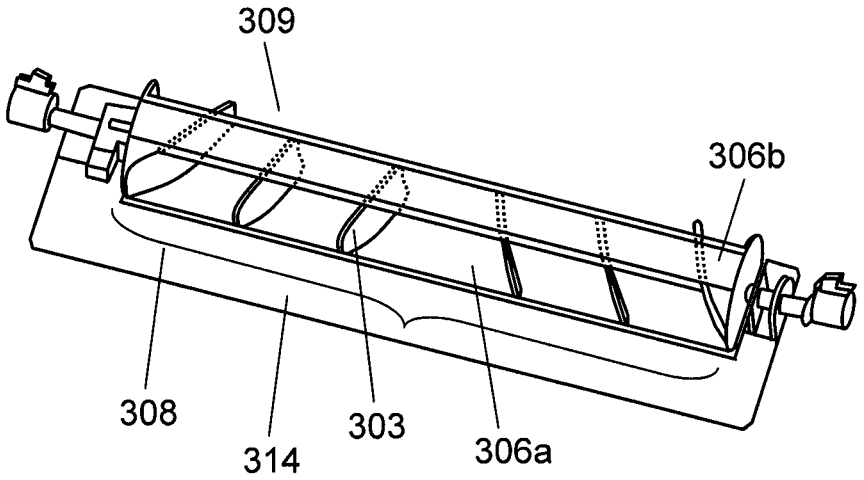
FIG. 32 shows a perspective inside view of the louver device of the clothes dryer.

FIG. 30 shows a perspective view of a positioning device of the louver device of the clothes dryer in accordance with the eighth embodiment. FIG. 31 shows a perspective outside view of the louver device of the clothes dryer. FIG. 32 shows a perspective inside view of the louver device of the clothes dryer.

Louver device 307 includes regulator 312 for regulating a rotating direction of louver device 307, and positioning device 313 for positioning louver device 307 at an end of rotating motion by touching louver device 307 to regulator 312 without fail.

Assistant flap 314 is provided around louver device 307 so that longer flap 306*a* of louver device 307 can move together with assistant flap 314. This structure allows air to travel distantly.

Next, operation of the louver device of the clothes dryer in accordance with the eighth embodiment is demonstrated hereinafter. When air approaches louvers 303, the attachment effect of fluid changes a direction of airflow, and the air flows along the shape of louvers 303. Since the air flows between flaps 306*a* and 306*b*, a direction of airflow is so determined as flows along flaps 306*a* and 306*b*, of which rotations on rotary shaft 305 regulate a blowing direction.

Reversal rotation of louver device 307 on rotary shaft 305 by using driver 304 allows diffusing the air from diffusion open side 308 or concentrating the air blow from concentration open side 309. When louver device 307 diffuses the air from concentration open side 308, louver device 307 makes to-and-fro motion on rotary shaft 305, and then reversely rotates on shaft 305 for concentrating the air blow from open side 309, and makes to-and-from motion on shaft 305. The foregoing motions are repeated alternately.

When louver device 307 is housed into clothes dryer 301, flaps 306*a*, 306*b* work as lids for closing the blow-off port. Louver device 307 thus should touch regulator 312 without fail before positioning device 313 determines the position of louver device 307. Flaps 306*a*, 306*b* are thus accurately positioned on the outer frame of clothes dryer 301, so that no gap or no space can be found between the outer frame and flaps 306*a*, 306*b*.

To-and-fro motion time controller 310 can change time intervals of the to-and-from motion of louver device 307, so that a speed of changing an air blow direction can be controlled depending on a degree of dryness in the clothes. To-and-fro motion angle controller 311 can set multiple to-and-fro motion angles because different angles are needed for drying the clothes hung on one pole from the clothes hung on two poles.

As discussed above, louvers 303, flaps 306*a*, 306*b* are unitarily formed, so that the number of components can be reduced, which results in reducing material cost and the number of assembling steps. This structure allows excellent control over the diffusion and concentration of airflow, and increasing a blowing efficiency due to a smaller resistance to the airflow. As a result, the louver device can advantageously save energy, and assist the clothes dryer to dry the clothes fast and to save energy.

Embodiment 9

Figure 33:
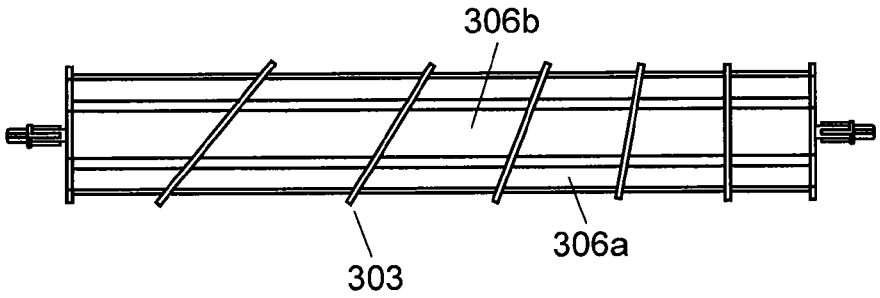
FIG. 33 shows a perspective view of a louver device of a clothes-dryer in accordance with a ninth embodiment of the present invention.

A clothes-dryer in accordance with the ninth embodiment includes structural elements similar to those in the eighth embodiment, so that those elements have the same reference signs and the detailed descriptions thereof are omitted here. FIG. 33 shows a perspective view of a louver device of the clothes dryer in accordance with the ninth embodiment.

Louver 303 closer to a first end of either one of flaps 306*a*, 306*b* is formed approx. vertically relative to rotary shaft 305, and another louver 303 closer to a second end thereof is formed slantingly relative to rotary shaft 305. A rotation or a reverse rotation of louver device 307 including louvers 303 discussed above on rotary shaft 305 allows diffusing or concentrating the airflow.

The foregoing structure allows controlling over the direction of airflow along the rotating direction of rotary shaft 305 as well as controlling over diffusion and concentration of the airflow. This structure thus produces a smaller resistance to the airflow than a structure where louvers and flaps are formed discretely, so that a pressure loss can be reduced. If louver device 307 is asymmetric relative to an object of airflow, it can work with advantages similar to what are discussed previously. The foregoing louver device can assist the clothes dryer to dry clothes fast with energy being saved.

Embodiment 10

Figure 34:
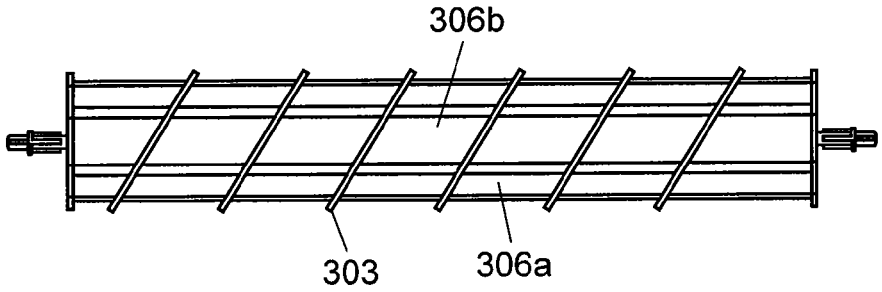
FIG. 34 shows a perspective view of a louver device of a clothes-dryer in accordance with a tenth embodiment of the present invention.
Figure 35:
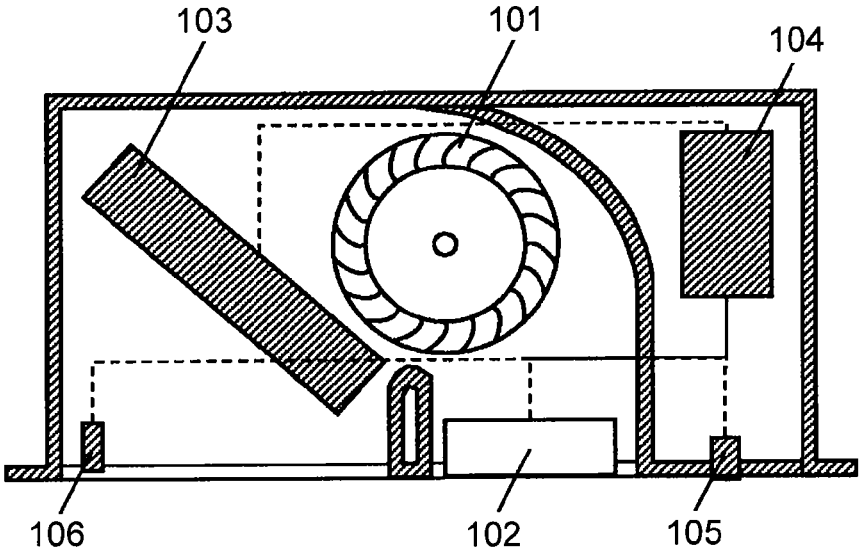
FIG. 35 PRIOR ART
FIG. 35 shows a sectional view of a conventional clothes dryer.
Figure 36:
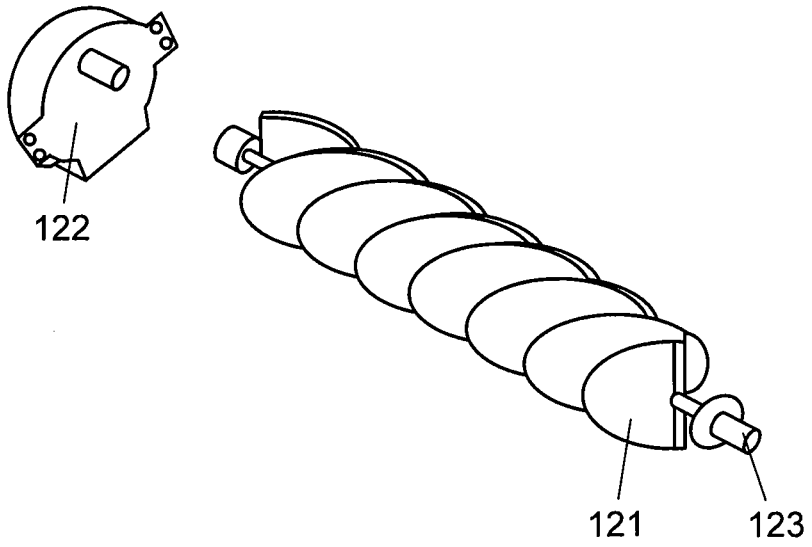
FIG. 36 PRIOR ART
FIG. 36 shows an external view of a louver device of the conventional clothes dryer.
Figure 37:
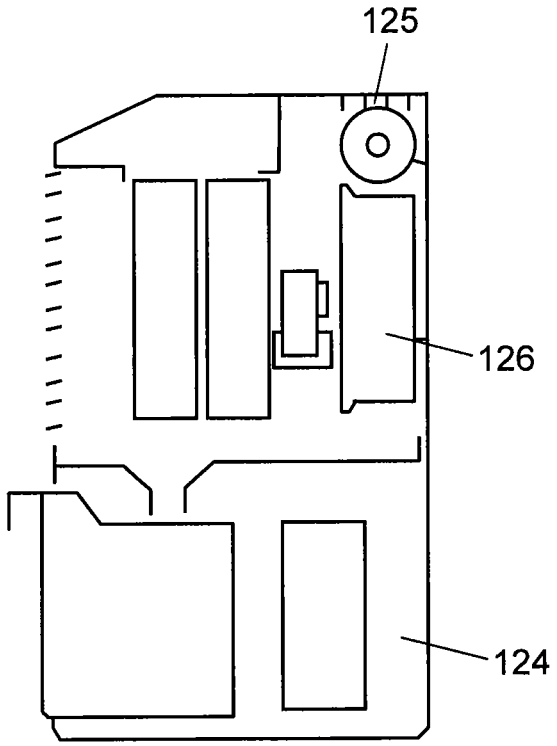
FIG. 37 PRIOR ART
FIG. 37 shows a sectional view of a main unit of the conventional clothes dryer.
Figure 38:
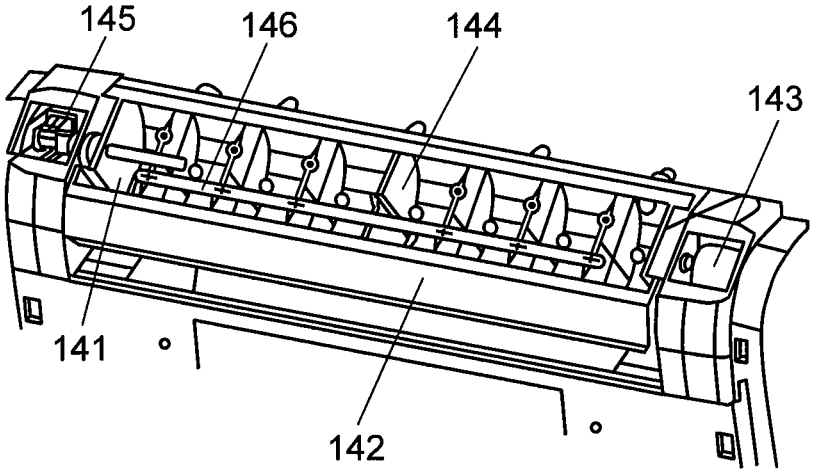
FIG. 38 PRIOR ART
FIG. 38 shows a perspective view illustrating a structure of a conventional louver device.

A clothes-dryer in accordance with the tenth embodiment includes structural elements similar to those in the eighth and ninth embodiments, so that those elements have the same reference signs and the detailed descriptions thereof are omitted here. FIG. 34 shows a perspective view of a louver device of the clothes dryer in accordance with the tenth embodiment.

Each one of louvers 303 of louver device 307 slants in the same direction relative to rotary shaft 305. A rotation or a reverse rotation of louver device 307 on rotary shaft 305 allows louvers 303 to change the airflow direction in a lateral direction.

Louvers 303, flaps 306*a*, 306*b* are unitarily formed, so that the airflow direction can be controlled along the rotating direction of rotary shaft 305. On top of that, blowing can be controlled axially and the airflow direction can be controlled in a lateral direction. This structure thus produces a smaller resistance to the airflow than a structure where louvers and flaps are formed discretely, so that a pressure loss can be reduced. The foregoing louver device can assist the clothes dryer to dry clothes fast with energy being saved.

The louver device of the clothes dryer of the present invention includes multiple louvers connected to a driver which rotates the louvers on a rotary shaft, and two flaps sandwiching the louvers. The louvers and the two flaps are formed unitarily. The louvers control an airflow direction axially, and the flaps control the airflow direction along a rotating direction of the rotary shaft. The louvers closer to the side-ends of the flaps slant at greater angles relative to the rotary shaft than the louvers closer to the center of the flaps. Two flaps mostly close to the sides-ends of the flaps slant in opposite direction to each other. The rotation or reverse rotation of the louvers on the rotary shaft thus can diffuse or concentrate the airflow. The unitary formation of louvers and flaps allows controlling the airflow direction along the rotating direction of the rotary shaft as well as controlling the airflow to diffuse or concentrate. This structure thus produces a smaller resistance to the airflow than the structure where louvers and flaps are formed discretely, so that a pressure loss can be reduced.

The louver device of the clothes dryer of the present invention includes multiple louvers connected to a driver which rotates the louvers on a rotary shaft, and two flaps sandwiching the louvers. The louvers and the two flaps are formed unitarily. The louvers control an airflow direction axially, and the flaps control the airflow direction along a rotating direction of the rotary shaft. A louver closer to a first end of either one of the flaps is formed approx. vertically relative to the rotary shaft, and another louver closer to a second end thereof slants with respect to the rotary shaft. A rotation or a reverse rotation of the louver device including the foregoing louvers on the rotary shaft allows diffusing or concentrating the airflow. The unitary formation of louvers and flaps thus allows controlling the airflow direction along the rotating direction of the rotary shaft as well as controlling the airflow to diffuse or concentrate. This structure thus produces a smaller resistance to the airflow than a structure where louvers and flaps are formed discretely, so that a pressure loss can be reduced. If the louver device is asymmetric relative to an object of airflow, it can work with advantages similar to what are discussed previously.

The louver device of the clothes dryer of the present invention includes multiple louvers connected to a driver which rotates the louvers on a rotary shaft, and two flaps sandwiching the louvers. The louvers and the two flaps are formed unitarily. The louvers control an airflow direction axially, and the flaps control the airflow direction along a rotating direction of the rotary shaft. Each one of the louvers slant in the same direction relative to the rotary shaft, and a rotation or a reverse rotation of the louvers on the rotary shaft allows changing the airflow direction in a lateral direction. The unitary formation of the louvers and the flaps allows controlling the airflow direction along the rotating direction of the rotary shaft as well as controlling the airflow direction axially in the lateral direction. This structure thus produces a smaller resistance to the airflow than a structure where louvers and flaps are formed discretely, so that a pressure loss can be reduced.

INDUSTRIAL APPLICABILITY

The clothes dryer of the present invention accurately determines a degree of dryness in clothes, and dries the clothes fast in an energy saving manner. It can be placed in a dressing room, a sauna bath, an exclusive room for drying clothes, a room not in-use, or a corridor. The clothes dryer can be used not only in a house but also in a clothes-drying room of a laundry, hospital, cooperative apartment, sports center, or hotel.

The invention claimed is:

1. A method of drying clothes, said method comprising the steps of:

blowing air on clothes with a blower;

measuring a difference in surface temperature between a) said clothes when air is blowing on said clothes, and b) said clothes when air is not being blown on said clothes;

determining, using a microprocessor a degree of dryness of said clothes based on said measuring;

further determining a time to add heating to said blowing based on said determining; and adding heating to said blowing at said time based on said further determining.

2. The control method as defined in claim 1, wherein the starting time for heating the clothes is determined by comparing a dry-end time predicted based on the degree of dryness in the clothes and a target dry-end time fixed in advance.

* * * * *